US007468230B2

(12) United States Patent
Azuma et al.

(10) Patent No.: US 7,468,230 B2
(45) Date of Patent: Dec. 23, 2008

(54) WET-DEVELOPING ELECTROPHOTOGRAPHIC PHOTOCONDUCTOR AND WET-DEVELOPING IMAGE

(75) Inventors: Jun Azuma, Osaka (JP); Fumio Sugai, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 455 days.

(21) Appl. No.: 10/563,507

(22) PCT Filed: Nov. 17, 2004

(86) PCT No.: PCT/JP2004/017081

§ 371 (c)(1),
(2), (4) Date: Jan. 5, 2006

(87) PCT Pub. No.: WO2005/050329

PCT Pub. Date: Jun. 2, 2005

(65) Prior Publication Data

US 2006/0166117 A1 Jul. 27, 2006

(30) Foreign Application Priority Data

Nov. 18, 2003 (JP) ..... 2003-387425
Mar. 15, 2004 (JP) ..... 2004-073552

(51) Int. Cl.
*G03G 5/047* (2006.01)

(52) U.S. Cl. ..... 430/74; 430/96

(58) Field of Classification Search ..... 430/74, 430/56, 96, 73
See application file for complete search history.

(56) References Cited

U.S. PATENT DOCUMENTS

| | | | | |
|---|---|---|---|---|
| 5,952,140 | A | 9/1999 | Visser et al. | |
| 6,593,047 | B2 * | 7/2003 | Azuma et al. | 430/96 |
| 2002/0045119 | A1 * | 4/2002 | Azuma et al. | 430/96 |
| 2002/0159804 | A1 * | 10/2002 | Azuma et al. | 399/350 |

FOREIGN PATENT DOCUMENTS

| | | |
|---|---|---|
| JP | 2000-66419 | 3/2000 |
| JP | 2002-311664 | 10/2002 |
| JP | 2003-005391 | 1/2003 |

* cited by examiner

*Primary Examiner*—John L Goodrow
(74) *Attorney, Agent, or Firm*—Carmody & Torrance LLP

(57) ABSTRACT

It is an object of the present invention to provide a wet-developing electrophotographic photoconductor which can be manufactured stably by making use of particular physical property indexes of an electron transport agent and a binding resin and possesses the excellent durability and the excellent solvent resistance and a wet-developing image forming device which uses such a wet-developing electrophotographic photoconductor. To achieve such an object, in a wet-developing electrophotographic photoconductor which forms a photosensitive layer containing at least a charge generating agent, an electron transport agent, a hole transport agent and a binding resin on an electrically conductive base body thereof and a wet-developing image forming device which uses the wet-developing electrophotographic photoconductor, an inorganic value/organic value (I/O value) of the electron transport agent is set to 0.60 or more and an inorganic value/organic value (I/O value) of the binding resin is set to 0.37 or more, or a molecular weight of the electron transport agent is set to a value equal to or more than 600 and an inorganic value/organic value (I/O value) of the binding resin is set to 0.37 or more.

11 Claims, 11 Drawing Sheets

(a)

(b)

WET-DEVELOPING ELECTROPHOTOGRAPHIC PHOTOCONDUCTOR AND WET-DEVELOPING IMAGE

CROSS REFERENCE TO RELATED APPLICATIONS

This application is a National Stage application of International Application No. PCT/JP2004/017081, filed Nov. 17, 2004.

TECHNICAL FIELD

The present invention relates to a wet-developing electrophotographic photoconductor which can be manufactured stably by making use of a particular physical property index and to a wet-developing image forming device which uses such a wet-developing electrophotographic photoconductor.

BACKGROUND OF THE INVENTION

Conventionally, there has been known a wet developing system in which the developing is performed by conducting an electrophoresis of toner particles on an electrostatic latent image on a surface of a photoconductor using a liquid developer which is formed by dispersing colorants, polymer particles and the like in a solvent of high electrical insulation. Further, according to the wet developing system, the toner particles contained in the solvent of the liquid developer are charged to a given polarity due to resin or a charge control agent which constitutes the toner particles and have a characteristic that the toner particles are easily dispersed in the solvent in a stable manner. Accordingly, the wet developing method, compared to a dry developing method, can perform the formation of image with high resolution using fine toner particles and, at the same time, the lowering of the local charge potentials due to leaking of charge can be suppressed and hence, the wet developing method is advantageous for the dry developing method in realizing the formation of image with high quality in a stable manner.

However, in performing the wet developing method, since a solvent of the liquid developer is required to have the high electrical insulation, a hydrocarbon-system solvent having high solubility such as isoparaffin is popularly used. Accordingly, such hydrocarbon-system solvent is brought into contact with a photosensitive layer for a long time and hence, a charge transport agent in the photosensitive layer is dissolved into the hydrocarbon-system solvent thus giving rise to a drawback that the sensitivity is lowered. Further, the binding region which forms the photosensitive layer swells due to the hydrocarbon-system solvent thus giving rise to drawbacks such as the softening of the photosensitive layer and the deterioration of durability attributed to the occurrence of cracks.

Accordingly, there has been proposed a technique which prevents the dissolution of a charge transport agent with the use of an organic photoconductor which forms an overcoat layer made of thermosetting resin on a surface thereof (see patent document 1, for example). However, the further formation of the overcoat layer gives rise to other drawbacks such as the remarkable deterioration of the sensitivity and the increase of a manufacturing cost.

Further, there has been proposed a technique which uses charge transport polymer for imparting a charge transport function to binding resin per se and decreases a content of a charge transport agent so as to increase the solvent resistance of the photosensitive layer (see patent document 2, for example). However, the molecular design of the charge transport polymer is not easy and hence, it is difficult to ensure the stable manufacture of the charge transport polymer thus giving rise to a drawback that the technique lacks the practicability. That is, the physical properties of the binding resin become irregular and hence, there have been drawbacks such as the irregular sensitivity characteristic of the photosensitive layer or the irregular dissolution amount of the charge transport polymer.

In view of such circumstances, inventors of the present invention have made an extensive study and have found out that when respective inorganic/organic values (I/O values) of an electron transport agent and a binding resin are set to values which fall within given ranges respectively or when a molecular weight of the electron transport agent and the inorganic/organic values (I/O values) of the binding resin are set to values which fall within given ranges, due to the interaction between these materials, the dispersibility and the stability of a hole transport agent are enhanced and, at the same time, the liquid developer can be manufactured in a stable manner. Further, as a result, the inventors have also found out that when the liquid developer is used in an image forming apparatus of a wet developing method, the liquid developer exhibits the favorable solvent resistance, wherein the charge transport agent (hole transport agent or electron transport agent) is hardly dissolved in a hydrocarbon-system solvent and a favorable image is obtainable.

That is, it is an object of the present invention to provide a wet-developing electrophotographic photoconductor which can be manufactured stably by making use of particular physical property indexes of an electron transport agent and a binding resin and possesses the excellent durability and the excellent solvent resistance and to a wet-developing image forming device which uses such a wet-developing electrophotographic photoconductor.

[Patent document 1] JP10-221875A

[Patent document 2] JP2003-57856A

DISCLOSURE OF THE INVENTION

[Problems to be Solved by the Invention]

According to the present invention, to overcome the above-mentioned drawbacks, there are provided a wet-developing electrophotographic photoconductor which forms a photosensitive layer containing at least a charge generating agent, an electron transport agent, a hole transport agent and a binding resin on a conductive substrate thereof, wherein an inorganic value/organic value (I/O value) of the electron transport agent is set to 0.60 or more, and an inorganic value/organic value (I/O value) of the binding resin is set to 0.37 or more, a wet-developing electrophotographic photoconductor which forms a photosensitive layer containing at least a charge generating agent, an electron transport agent, a hole transport agent and a binding resin on a conductive substrate thereof, wherein a molecular weight of the electron transport agent is set to 600 or more, and an inorganic value/organic value (I/O value) of the binding resin is set to 0.37 or more, and a wet-developing image forming device which uses these wet-developing electrophotographic photoconductors.

That is, the wet-developing electrophotographic photoconductor is formed such that the photoconductor includes the electron transport agent and the binding resin having such particular physical property indexes, wherein these components exhibit given interactions and hence, the dispersibility and the stability of the hole transport agent are enhanced and, at the same time, it is possible to stably manufacture the wet-developing electrophotographic photoconductor by making use of the particular physical indexes. Further, by applying the wet-developing electrophotographic photoconductor to the wet-developing image forming device, the wet-developing image forming device can obtain the excellent durability and the solvent resistance.

BEST MODE FOR CARRYING OUT THE INVENTION

First Embodiment

The first embodiment is directed to a wet-developing electrophotographic photoconductor which forms a photosensitive layer containing at least a charge generating agent, an electron transport agent, a hole transport agent and a binding resin on a conductive substrate thereof, wherein an inorganic value/organic value (I/O value) of the electron transport agent is set to 0.60 or more, and an inorganic value/organic value (I/O value) of the binding resin is set to 0.37 or more.

Here, although the wet-developing electrophotographic photoconductor is classified into a single-layer type and a stacked-layer type, the wet-developing electrophotographic photoconductor of the present invention is applicable to both of the single-layer type and the stacked-layer type.

However, in view of the reasons that the single-layer type photoconductor is compatible with both of positive and negative charges, the single-layer type photoconductor has the simple structure and can be easily manufactured, the single-layer type photoconductor can suppress the occurrence of a film defect in forming the photosensitive layer, and the single-layer type photoconductor has a small interlayer thickness and can enhance an optical characteristic, it is preferable to adopt the wet-developing electrophotographic photoconductor of the present invention to the single-layer type photoconductor.

1. Single-layer Type Photoconductor (1) Basic Constitution

Figure 1:
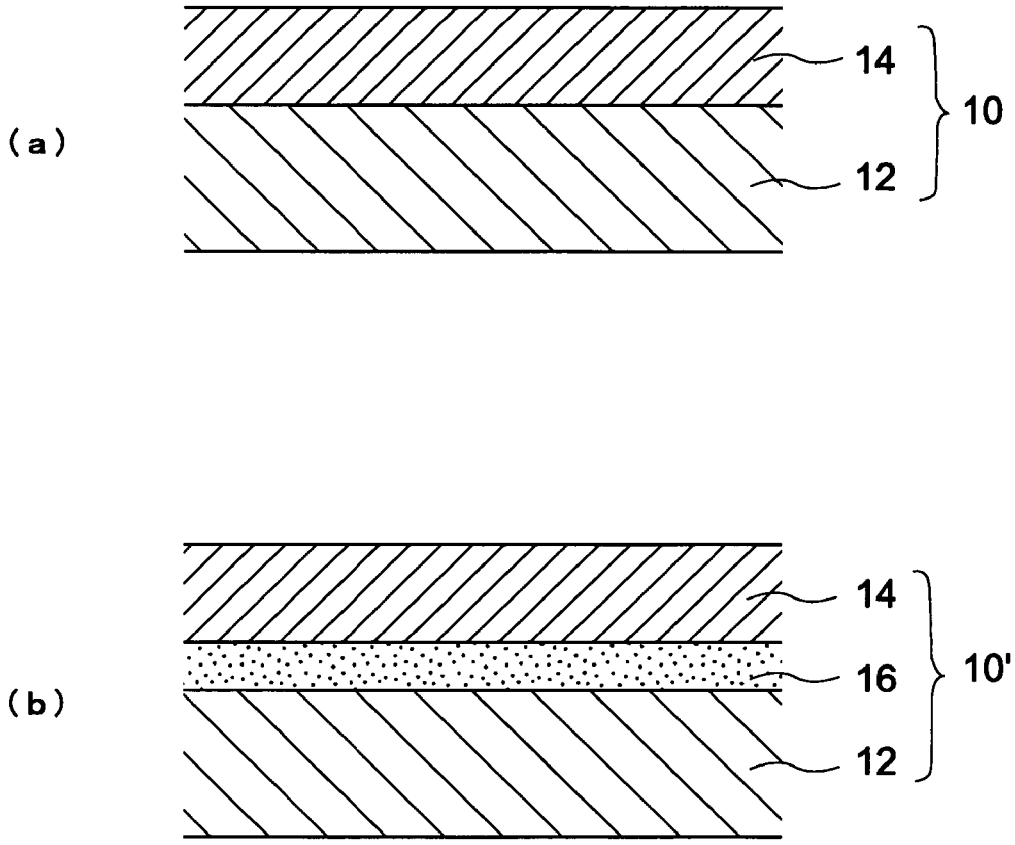
FIG. 1(*a*) and FIG. 1(*b*) are views served for explaining the basic structure of a single-layered photoconductor.

As shown in FIG. 1(*a*), the single-layer type photoconductor 10 is configured such that a single photosensitive layer 14 is formed on a conductive substrate 12.

The photosensitive layer is formed, for example, by dissolving or dispersing the hole transport agent, the electron transport agent, the charge generating agent, the binding resin and, further, a leveling agent or the like when necessary into a proper solvent, by applying the obtained coating liquid onto the conductive substrate by coating, and by drying the coated liquid. Such a single-layer type photoconductor is applicable to both of positive and negative charge types with the single constitution and also possesses the simple layer structure and hence, the single-layer type photoconductor exhibits the excellent productivity.

Here, as illustrated in FIG. 1(*b*), it may be possible to provide an electrophotographic photoconductor 10' which forms the photosensitive layer 14 on the conductive layer 12 by way of an intermediate layer 16.

(2) Electron Transport Agent (2)-1 Inorganic Value/Organic Value

According to the present invention, as the electron transport agent, irrespective of the type, the electron transport agent which exhibits the inorganic value/organic value (hereinafter, I/O value) of 0.6 or more is used.

Figure 2:
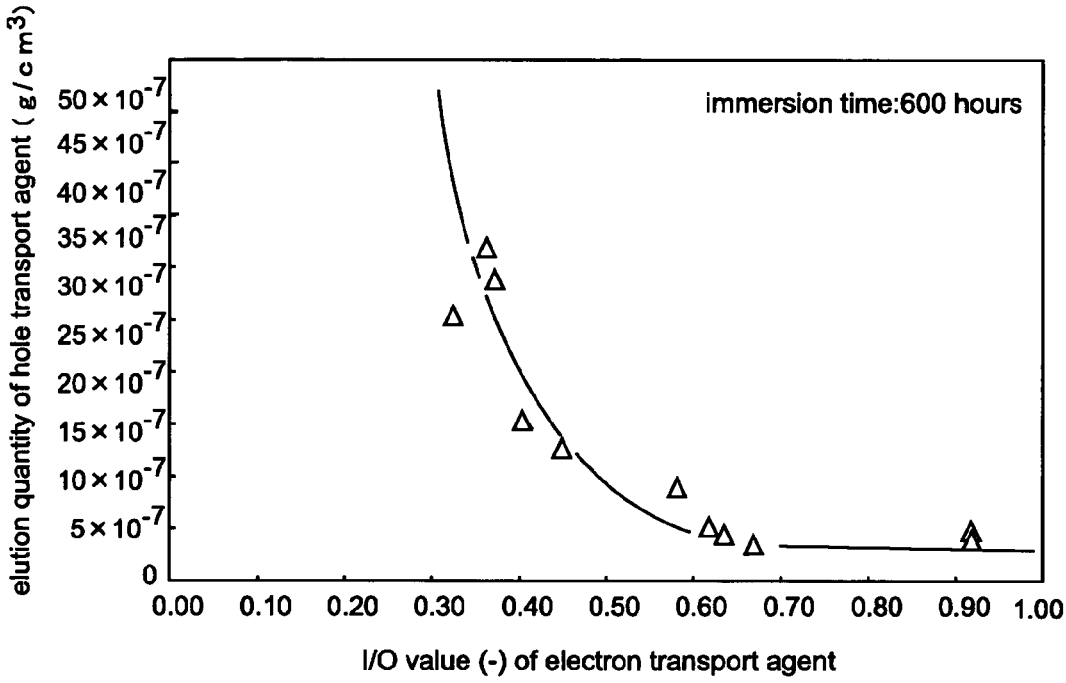
FIG. 2 is a view showing the relationship between an I/O value of an electron transport agent and an elution quantity of a hole transport agent.

The reason is that due to an interaction between the electron transport agent and the binding resin which possesses a particular I/O value described later, the dispersibility and the stability of the hole transport agent are enhanced whereby, as shown in FIG. 2, the hole transport agent is hardly dissolved into the hydrocarbon-system solvent which exhibits the large organic property.

Figure 3:
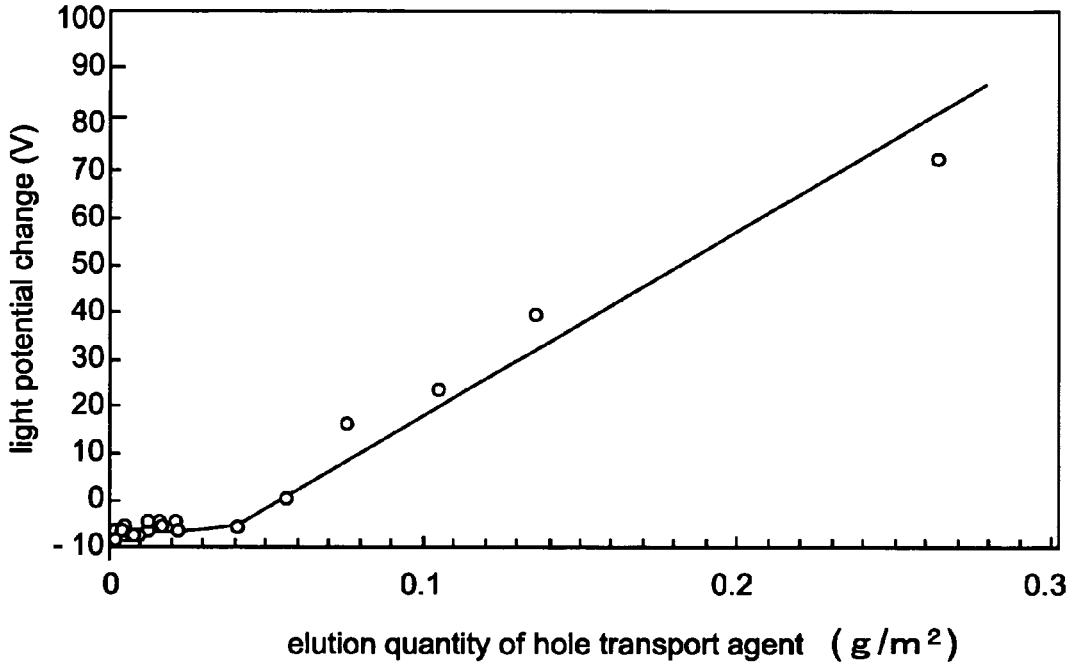
FIG. 3 is a view showing the relationship between an elution quantity of a hole transport agent and a light potential change of a wet-developing electrophotographic photoconductor.

Accordingly, even when the single-layer-type photoconductor 10 is used in the wet-developing image forming device using a developing solution in which toner particles are dispersed in a hydrocarbon-system solvent, the wet-developing image forming device can obtain the excellent solution resistance and durability. Further, as shown in FIG. 3, the wet-developing image forming device can obtain the excellent image characteristic (light potential).

However, when the value of the I/O value becomes excessively large, there may be a case that the solubility of the electron transport agent with respect to the solvent and the binding resin is lowered, or crystallized, or the electric characteristic of the photoconductor is lowered. Accordingly, it is more preferable that the I/O value of the electron transport agent is set to a value which falls within a range of 0.6 to 1.7. It is further more preferable that the I/O value of the electron transport agent is set to a value which falls within a range of 0.65 to 1.6.

Here, in the present invention, the inorganic value/organic value (hereinafter also referred to as the I/O value) is a value which treats polarities of various organic compounds in an organic conceptual manner and is explained in detail in documents such as KUMAMOTO PHARMACEUTICAL BULLETIN, 1$^{st}$ issue, paragraphs 1 to 16 (1954); KAGAKUNO-RYOUIKI (Realm of Chemistry), Volume 11, 10$^{th}$ issue, paragraphs 719 to 725 (1957); Fragrance Journal, 34$^{th}$ issue, paragraphs 97 to 111 (1979); Fragrance Journal, 50$^{th}$ issue, paragraphs 79 to 82 (1981) and the like, for example. That is, assuming that one piece of carbon (C) possesses the organic property of 20, using such organic property as the reference, the inorganic values and the organic values of respective polarity groups are determined as shown in Table 1, and a sum (I value) of the inorganic polarity values in the respective polarity groups (I value) and a sum of the organic values in the respective polarity group (O value) are obtained, and the respective ratios are set as the I/O values. Here, in Table 1, R mainly represents an alkyl group and Φ represents mainly alkyl group or aryl group.

compound possesses. For example, as shown in Table 1, the inorganic value of the —COOH group is 150 and the inorganic value of the double bond is 2. Accordingly, the inorganic value of a kind of organic compound implies the sum of inorganic values of the various substituent groups, the bonds and the like which the organic compound possesses.

On the other hand, the organic value is, using a methylene group in the molecule as a unit, determined based on the influence of the carbon atoms which represent the methylene group to a boiling point as a reference. That is, an average value of boiling-point elevation by adding one carbon in the

TABLE 1

| Inorganic Group | Value Inorganic | Organic and Inorganic Group | Value Organic | Value Inorganic |
|---|---|---|---|---|
| Light Metals | 500< | $R_4Bi$—OH | 80 | 250 |
| Heavy Metals, Amine and NH4 salt | 400< | $R_4Sb$—OH | 60 | 250 |
| —$AsO_3H_2$, >$AsO_2H$ | 300 | $R_4As$—CH | 40 | 250 |
| —$SO_2$—NH—CO—, —N═N—$NH_2$ | 260 | $R_4P$—OH | 20 | 250 |
| =>$N^+$—OH, —$SO_3H$, —$NHSO_2$—NH | 250 | —O—$SO_3H$ | 20 | 220 |
| —CO—NHCO—NHCO— | 250 | >$SO_2$ | 40 | 170 |
| ->S—OH, —CONH—CONH—CONH—, —$SO_2NH$— | 240 | >SO | 40 | 140 |
| —CS—NH—, —CONH—CO— | 230 | —CSSH | 100 | 80 |
| ═N—OH—, —NHCONH— | 220 | —SCN | 90 | 80 |
| ═N—NH—, —CONH—$NH_2$ | 210 | —CSOH, —COSH | 80 | 80 |
| —CONH— | 200 | —NCS | 90 | 75 |
| ->N->O | 170 | —Bi< | 80 | 70 |
| —COOH | 150 | —$NO_2$ | 70 | 70 |
| Lactone cyclization | 120 | —Sb< | 60 | 70 |
| —CO—O—CO— | 110 | —As<, —CN | 40 | 70 |
| Anthrathene nucleus, Phenanthrene nucleus | 105 | —P< | 20 | 70 |
| —OH | 100 | —CSS ø | 130 | 50 |
| >Hg (Oranic bond) | 95 | —CSO ø, —COS ø | 80 | 50 |
| —NH—NH, —O—CO—O— | 80 | —NO | 50 | 50 |
| —N<(—$NH_2$, —NH ø, —N $ø_2$) Amine | 70 | —O—$NO_2$ | 60 | 40 |
| >CO | 65 | —NC | 40 | 40 |
| —COO ø, Naphthalene nucleus, Quinoline nucleus* | 60 | —Sb═Sb— | 90 | 30 |
| >C═NH | 50 | —As═As— | 60 | 30 |
| —O—O— | 40 | —P═P—, —NCO | 30 | 30 |
| —N═N— | 30 | —O—NO, —SH, —S— | 40 | 20 |
| —O— | 20 | −1 | 80 | 10 |
| Benzene nucleus (Aromatic single ring), Pyrididine nucleus | 15 | —Br | 60 | 10 |
| Ring (non-aromatic single ring) | 10 | ═S | 50 | 10 |
| Triple bond | 3 | —Cl | 40 | 10 |
| Double bond | 2 | —F | 5 | 5 |
| —($OCH_2CH_2$)—, Sugar ring—O— | 75 | iso ramification>- | −10 | 0 |
| | (20) | tert ramification->- | −20 | 0 |

Here, to further explain the concept of the I/O value, the I/O value may be referred to as an index which, in a state that the property of the compound is classified into an organic group which expresses the covalent bonding and an inorganic group which expresses the ionic bonding, positions all organic compounds at respective points on the rectangular coordinates which have an organic axis and an inorganic axis. That is, the inorganic value is a value obtained by expressing the magnitudes of influences that the various substituent groups and bonds which the organic compound possesses with respect to a boiling point by numerical values using a hydroxyl group as the reference. To be more specific, to sample the distance between a boiling-point curve of straight-chain alcohol and a boiling-point curve of straight-chain paraffin in the vicinity of the carbon number of 5, the distance becomes approximately 100° C. and hence, a numerical value of the influence of one hydroxyl group is set to 100. The values which are obtained by expressing the influences of various substituent groups or various bonds to the boiling point by numerical values are the inorganic values of the substituent groups which the organic vicinity of carbon number of 5 to 10 of the straight-chain saturated hydrocarbon compound is 20° C. and hence, the organic value of one hydrocarbon is set to 20. The organic values are values which are obtained by expressing the influence of the various substituent groups, bonds or the like on the boiling point using numerical values. For example, as shown in Table 1, the inorganic value of the nitro group (—$NO_2$) is 70. Accordingly, the organic value of a kind of organic compound implies the sum of organic values of the various substituent groups, the bonds and the like which the organic compound possesses. Accordingly, the I/O value of ETM-1 described later is calculated as follows.

(Organic Factor)

The organic factor includes 27 pieces of carbon atoms having organic property (organicity) of 20. Accordingly, the organic value becomes 540 (=20×27).

(Inorganic Factor)

The inorganic factor includes one piece of naphthalene ring having inorganic property (inorganicity) of 60.

The inorganic factor includes one piece of benzene ring having inorganic property of 15.

The inorganic factor includes two pieces of amine (—N<) having inorganic property of 70.

The inorganic factor includes one piece of oxygen atom (—O—) having inorganic property of 20.

The inorganic factor includes four pieces of keton (>CO) having inorganic property of 65.

Accordingly, the inorganic value (I value) of ETM-1 becomes 495 (=60+15+70×2+20+65×4). That is, the I/O value of the ETM-1 is obtained by 495/540=0.917.

(2)-2 Interaction with Biding Resin

Next, the interaction between the electron transport agent having the specific I/O value and the binding resin having the specific I/O value described later is explained in conjunction with FIG. 4.

Figure 4:
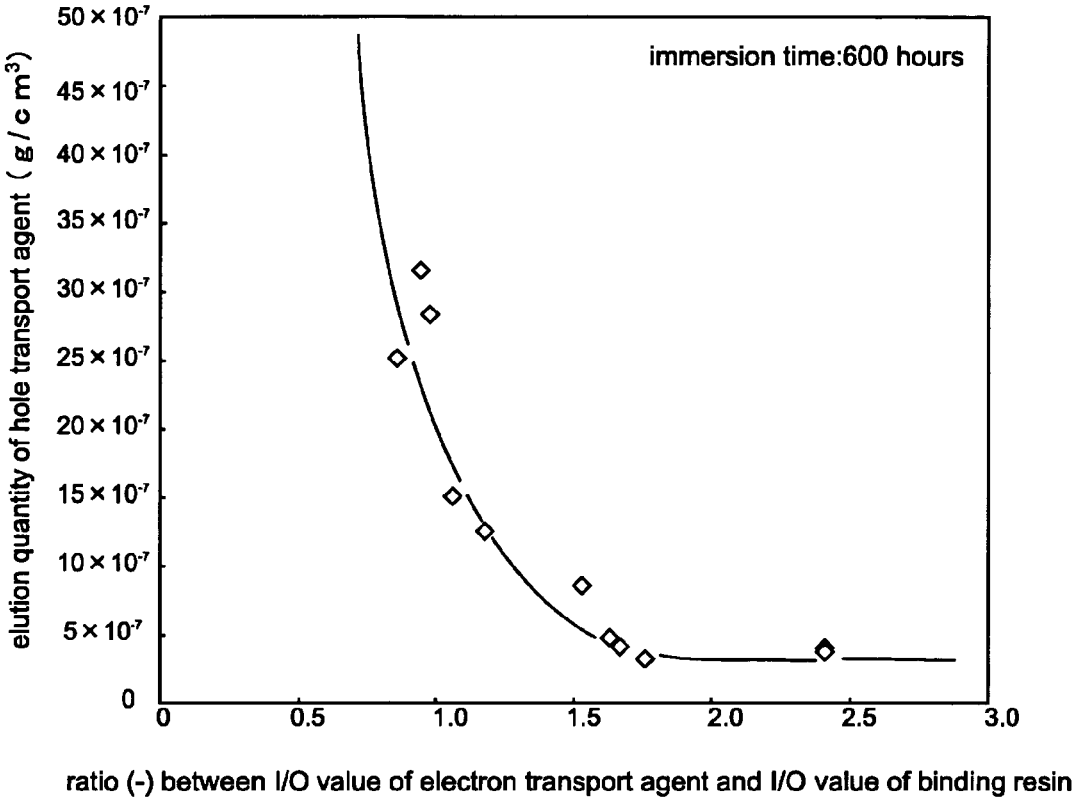
FIG. 4 is a view showing the relationship of a ratio between an I/O value of an electron transport agent and an I/O value of binding resin and an elution quantity of a hole transport agent.

In FIG. 4, on an axis of abscissas, a ratio (–) between the I/O value of the electron transport agent and the I/O value of the binding resin is taken on the premise that the I/O value of the binding resin is 0.37 or more, while on an axis of ordinates, an elution quantity ($g/cm^3$) of the electron transport agent when the photoconductor is immersed in a given developer under conditions of room temperature and an immersing time of 600 hours is taken.

Here, the ratio (–) between the I/O value of the electron transport agent and the I/O value of the binding resin is a ratio of the I/O value of the electron transport agent with respect to the I/O value of the binding resin. For example, when the I/O value of the binding resin is 0.381 and the I/O value of the electron transport agent is 0.917, the ratio (–) between the I/O value of the electron transport agent and the I/O value of the binding resin becomes 2.4.

As can be easily understood from FIG. 4, by combining the electron transport agent having the specific I/O value and the binding resin having the specific I/O value described later and by adjusting the ratio between these I/O values, the interaction is effectively generated and the elution quantity ($g/cm^3$) of the hole transport agent can be adjusted. For example, when the ratio (–) between the I/O value of the electron transport agent and the I/O value of the binding resin is approximately 1.0, the generation of the interaction is insufficient and the elution quantity of the hole transport agent assumes a relatively high value of $20\times10^{-7}$ ($g/cm^3$). To the contrary, when the ratio (–) between the I/O value of the electron transport agent and the I/O value of the binding resin becomes approximately 1.5, the interaction is favorably generated and the elution quantity of the electron transport agent is lowered to $8\times10^{-7}$ ($g/cm^3$). Further, when the ratio (–) between the I/O value of the electron transport agent and the I/O value of the binding resin becomes 1.8 or more, the interaction is sufficiently generated and the elution quantity of the hole transport agent assumes an extremely low value of $5\times10^{-7}$ ($g/cm^3$) or less.

That is, due to the combination of the electron transport agent having the specific I/O value and the binding resin having the specific I/O value described later, the interaction is effectively generated and hence, the dispersibility and the stability of the hole transport agent are enhanced whereby the hole transport agent is hardly eluted in the hydrocarbon solvent having the large organic property.

On the other hand, when the I/O value of the binding resin assumes a value less than 0.37, even when the electron transport agent having the specific I/O value and the binding resin having the specific I/O value described later are combined and the ratio between the I/O values is adjusted, the interaction is not generated effectively whereby there may be a case that the adjustment of the elution quantity ($g/cm^3$) of the hole transport agent may become difficult.

Accordingly, by selecting the kinds of the electron transport agent and the bonding resin using the I/O values of the electron transport agent and the binding resin as indexes respectively and by properly combining the electron transport agent and the binding resin, it is possible to manufacture the wet-developing electrophotographic photoconductor in a stable manner. That is, with the use of such a wet-developing electrophotographic photoconductor in a wet-developing image forming device, the given interaction is generated thus realizing the wet-developing image forming device which exhibits the excellent durability and the solvent resistance property in a stable manner.

(2)-3 Kinds

Further, as for the kinds of the electron transport agent, although there is no particular limitation so long as the I/O value is equal to or more than 0.6, besides a diphenoquinone derivative and a benzoquinone derivative, for example, a single kind of or a combination of two or more kinds of electron-accepting chemical compounds such as an anthraquinone derivative, a malononitrile derivative, a thiopyran derivative, a trinitro thioxanthone derivative, a 3, 4, 5, 7-tetranitro-9-fluorenone derivative, a dinitro anthracene derivative, a dinitro acridine derivative, a nitro anthraquinone derivative, a dinitro anthraquinone derivative, a tetracyanoethylene, 2,4,8-trinitro thioxanthone, dinitro benzene, dinitro anthracene, dinitro acridine, nitro anthraquinone, dinitro anthraquinone, succinic anhydride, maleic anhydride, dibromo maleic anhydride and the like may be named.

Further, as for kinds of the electron transport agent, it is preferable that electron transport agent includes a naphthoquinone derivative or an azo quinine derivative.

The reason is that such a compound exhibits, as the electron transport agent, the excellent electron accepting property and the excellent compatibility with the charge generating agent and hence, it is possible to provide the wet-developing electrophotographic photoconductor which exhibits the excellent sensitivity characteristics and solvent resistance.

Further, with respect to the kinds of the electron transport agent, it is preferable that the electron transport agent includes at least one nitro group (—$NO_2$), a substituted carboxyl group (—COOR (R being a substituted or unsubstituted alkyl group having 1 to 20 carbons, and a substituted or unsubstitutedaryl group having 6 to 30 carbons) and a substituted carbonyl group (—COR (R being a substituted or unsubstituted alkyl group having 1 to 20 carbons, or a substituted or unsubstituted aryl group having 6 to 30 carbons).

The reason is that with the use of such specific substituted groups, it is possible to provide the wet-developing electrophotographic photoconductor which exhibits the excellent solvent resistance.

Further, as for the kinds of such an electron transport agent, specifically, it is preferable to include chemical compounds represented by the following general formulae (3), (4), and (5).

(3)

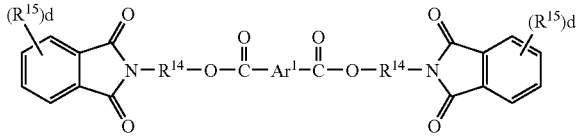

(4)

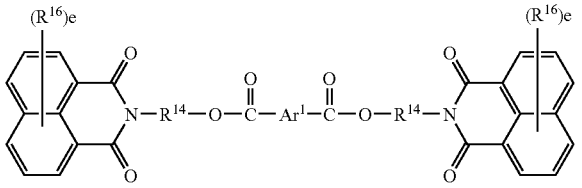

(5)

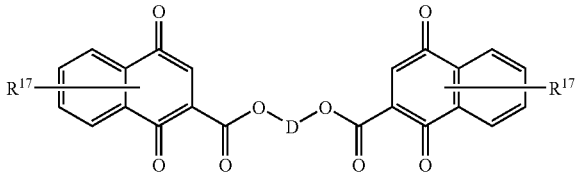

(In the general formulae (3) to (5), $R^{14}$ is an alkylene group having 1 to 8 carbons, an alkylidene group having 2 to 8 carbons, or an organic group of divalent represented by a general formula: —$R^{18}$—$Ar^1$—$R^{19}$— (wherein $R^{18}$ and $R^{19}$ are respectively independent and represent an alkylene group having 1 to 8 carbons or an alkylidene group having 2 to 8 carbons, while $Ar^1$ represents an arylene group having 6 to 18 carbons) and $R^{15}$ to $R^{17}$ are respectively independent and represent a halogen atom, a nitro group, an alkyl group having 1 to 8 carbons, an alkenyl group having 2 to 8 carbons or an aryl group having 6 to 18 carbons, wherein d and e are respectively independent and represent integers from 0 to 4. D is an alkylene group of an individual combination and having 1 to 8 carbons, an alkylidene group having 2 to 8 carbons or a divalent organic compound having 2 to 8 carbons represented by a general formula: —$R^{20}$—$Ar^1$—$R^{21}$— ($R^{20}$ and $R^{21}$ are respectively independent and represent an alkylene group having 1 to 8 carbons or an alkylidene group having 2 to 8 carbons while $Ar^1$ represents an arylene group having 6 to 18 carbons)).

Also as an electron transport agent, specific examples of the formulae (3) to (5) (ETM-5 to 7) and other preferable specific examples are described in the following formula (6). It is preferable to use a naphthalenecarboxylic acid derivative, a naphthoquinone derivative, an azoquinone derivative having a given I/O value (ETM-1 to 8) and the like.

Formula (6)

ETM-1

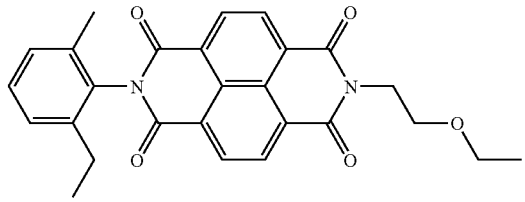

I/O value 0.917

$C_{27}H_{24}N_2O_5$
Mol. Wt.: 456.49

ETM-2

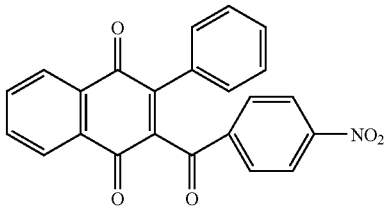

I/O value 0.670

$C_{23}H_{13}NO_5$
Mol. Wt.: 383.35

ETM-3

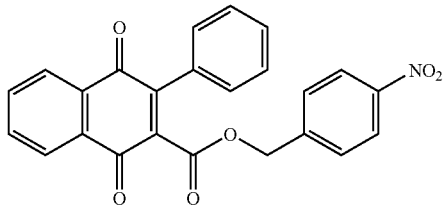

I/O value 0.636

$C_{24}H_{15}NO_6$
Mol. Wt.: 413.38

ETM-4

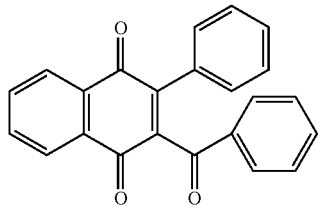

I/O value 0.620

$C_{23}H_{14}O_3$
Mol. Wt.: 338.36

-continued

ETM-5

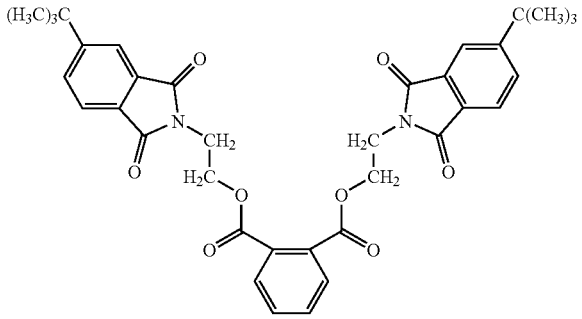

I/O value 0.860

$C_{36}H_{36}N_2O_8$
Mol. Wt.: 624.68

ETM-6

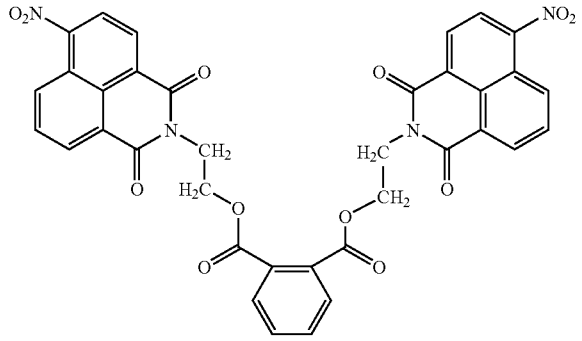

I/O value 0.948

$C_{36}H_{22}N_4O_{12}$
Mol. Wt.: 702.58

ETM-7

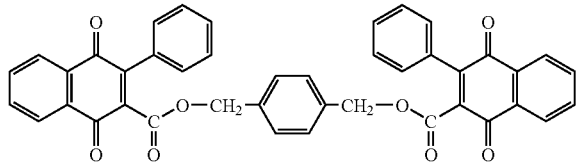

I/O value 0.649

$C_{42}H_{26}O_8$
Mol. Wt.: 658.65

ETM-8

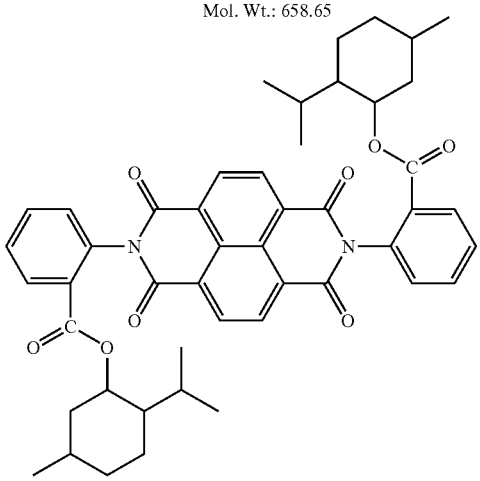

I/O value 0.692

$C_{48}H_{50}N_2O_8$
Mol. Wt.: 782.92

Here, it is further preferable to use in a single form or in combination with a conventionally known electron transport agent. As kinds of such an electron transport agent, besides a diphenoquinone derivative and a benzoquinone derivative, various kinds of electron-accepting chemical compounds such as an anthraquinone derivative, a malononitrile derivative, a thiopyran derivative, a trinitro thioxanthone derivative, a 3,4,5,7-tetranitro-9-fluorenone derivative, a dinithro anthracene derivative, a dinitro acridine derivative, a nitro anthraquinone derivative, a dinithro anthraquinone derivative, tetracyanoethylene, 2,4,8-trinitro thioxanthone, dinitro benzene, dinitro anthracene, dinitro acridine, nitro anthraquinone, dinitro anthraquinone, succinic anhydride, maleic anhydride, dibromo maleic anhydride and the like may be named and it is preferable to use a single kind or two or more kinds in a blended manner.

(2)-4 Addition Quantity

Also, it is preferable to set an addition quantity of the electron transport agent to a value which falls within a range of 10 to 100 parts by weight with respect to 100 parts by weight of the binding resin.

The reason is that when the addition quantity of electron transport agent assumes a value which is below 10 parts by weight, the sensitivity is lowered and there may arise a drawback in practical use. On the other hand, when the addition quantity of the electron transport agent exceeds 100 parts by weight, the electron transport agent is liable to be easily crystallized and hence, there may be a case that the formation of a film which has a proper thickness as the photoconductor becomes difficult.

Accordingly, it is more preferable to set the addition quantity of the electron transport agent to a value which falls within a range of 20 to 80 parts by weight with respect to 100 parts by weight of the binding resin.

Here, in determining the addition quantity of the electron transport agent, it is preferable to take the addition quantity of the hole transport agent into consideration. To be more specific, it is preferable to set an addition rate (ETM/HTM) of the electron transport agent (ETM) with respect to the hole transport agent (HTM) to a value which falls within a range of 0.25 to 1.3. The reason is that when the rate of ETM/HTM assumes a value which does not fall in such a range, the sensitivity is lowered and may give rise to drawbacks in practical use. Accordingly, it is more preferable to set the rate of ETM/HTM to a value which falls within a range of 0.5 to 1.25.

(2)-5 Molecular Weight

Figure 5:
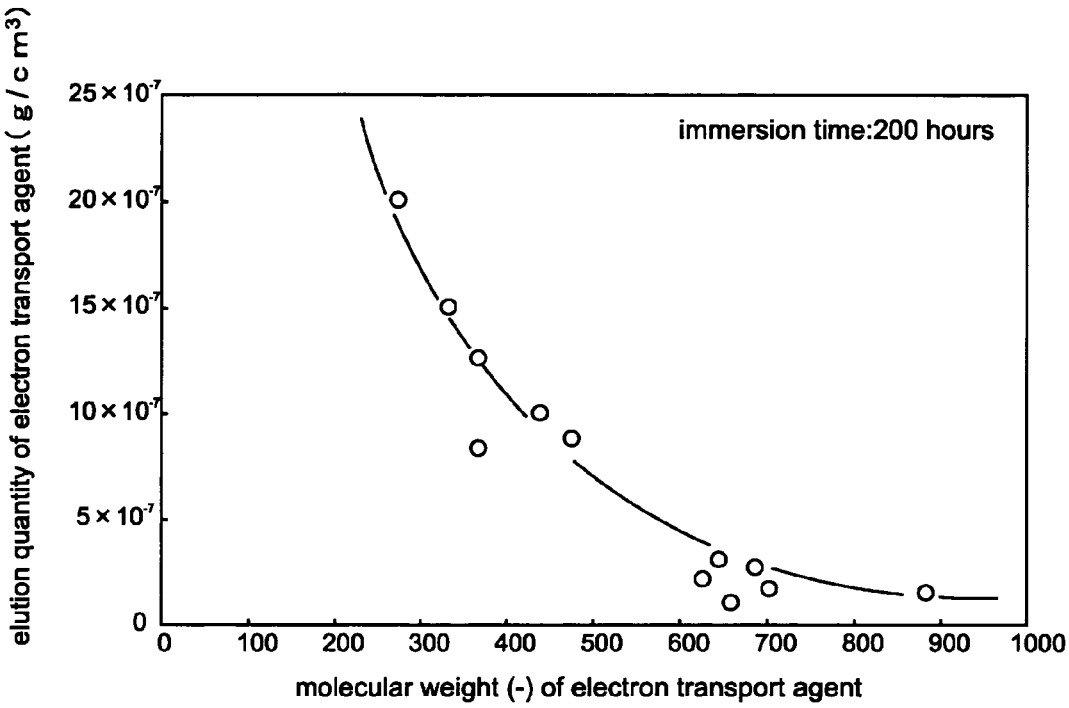
FIG. 5 is a view showing the relationship of a molecular weight of an electron transport agent and an elution quantity of the electron transport agent.
Figure 6:
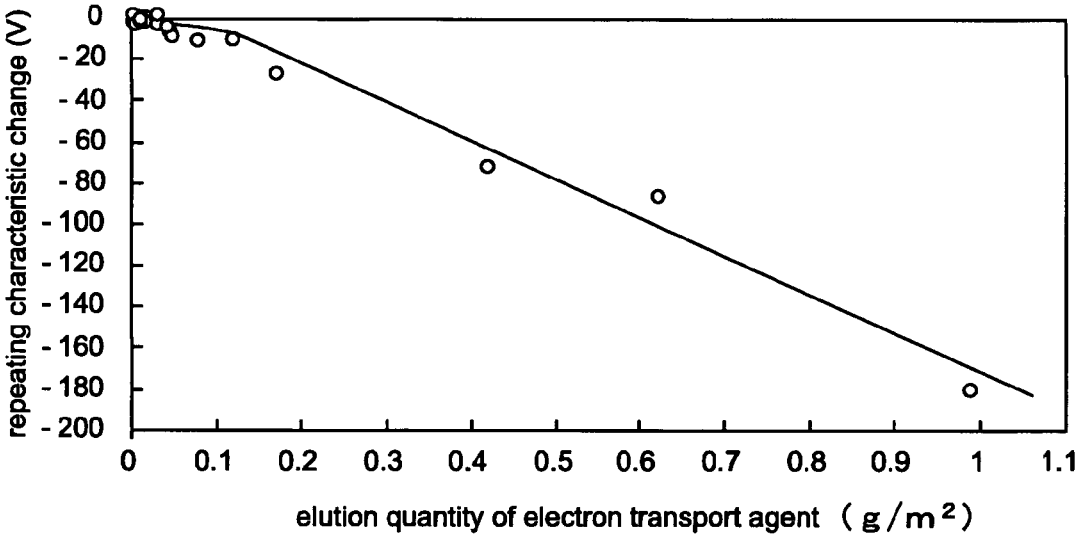
FIG. 6 is a view showing the relationship of an elution quantity of an electron transport agent and a repeating characteristic change of a wet-developing electrophotographic photoconductor.

Also, it is preferable to set a molecular weight of the electron transport agent to a value equal to or more than 600. The reason is that by setting the molecular weight of the electron transport agent to the value equal to or more than 600, as shown in FIG. 5 and FIG. 6, the solvent resistance of the electron transport agent against a hydrocarbon solvent can be enhanced and hence, the elusion of the electron transport agent from the photosensitive layer can be effectively suppressed, and the change of the repeating characteristics in the photosensitive layer can be remarkably reduced.

However, when the molecular weight of the electron transport agent becomes excessively large, there may be a case that the dispersibility of the electron transport agent in the photosensitive layer is lowered or the hole transport function is lowered.

Accordingly, it is more preferable to set the molecular weight of the electron transport agent to a value which falls within a range of 600 to 2000 and it is still more preferable to set the molecular weight of the electron transport agent to a value which falls within a range of 600 to 1000.

Here, the molecular weight of the electron transport agent may be calculated based on the constitutional formula or based on a mass spectrum.

(3) Hole Transport Agent (3)-1 Kinds

Further, as kinds of a hole transport agent, for example, a single kind or a combination of two or more kinds of a N,N,N',N'-tetraphenylbenzidine derivative, a N,N,N',N'-tetraphenylphenylenediamine derivative, a N,N,N',N'-tetraphenylnaphthylenediamine derivative, a N,N,N',N'-tetraphenylphenantolylendiamine derivative, an oxadiazole type chemical compound, a stilbene type compound, a styryl type chemical compound, a carbazole type compound, an organic polysilane chemical compound, a pyrazoline type chemical compound, a hydrazone type chemical compound, an indole type chemical compound, an oxazole type chemical compound, an isoxazole type chemical compound, a thiazole type chemical compound, a thiadiazole type chemical compound, an imidazole type chemical compound, a pyrazole type chemical compound, a triazole type chemical compound and the like may be named. In these hole transport agents, a stilbene type chemical compound having a site represented by a general formula (2) is more preferable.

(2)

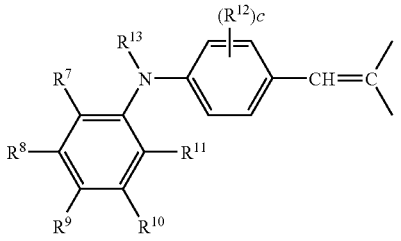

(In the general formula (2), $R^7$ to $R^{13}$ are respectively independent, and represent a hydrogen atom, a halogen atom, a substituted or unsubstituted alkyl group having 1 to 20 carbons, a substituted or unsubstituted alkenyl group having 2 to 20 carbons, a substituted or unsubstituted aryl group having 6 to 30 carbons, a substituted or unsubstituted aralkyl group having 6 to 30 carbons, a substituted or unsubstituted azo group, or a substituted or unsubstituted diazo group having 6 to 30 carbons and the repetition number c is an integer from 1 to 4.)

Here, as such a hole transport agent, more specifically, a stilbene derivative represented by the general formula (7) or the general formula (8) may be named.

(7)

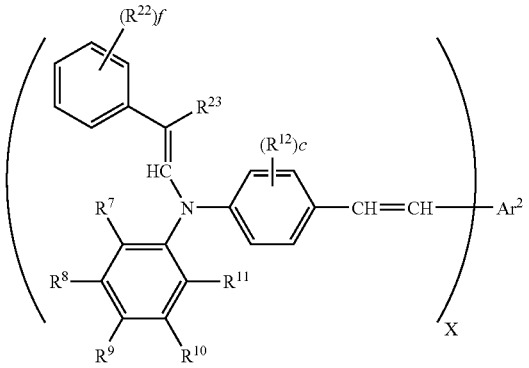

(In general formula (7), $R^7$ to $R^{12}$ and c are as same as the contents of the general formula (2) wherein $R^{22}$ and $R^{23}$ are respectively independent and represent a hydrogen atom, a halogen atom, a substituted or unsubstituted alkyl group having 1 to 20 carbons, a substituted or unsubstituted alkenyl group having 2 to 20 carbons, a substituted or unsubstituted aryl group having 6 to 30 carbons, a substituted or unsubstituted aralkyl group having 6 to 30 carbons, or a hydrocarbon ring structure formed by two neighboring $R^{22}$s being combined or condensed, and the repetition number f is an integer from 1 to 5, and X is an integer of 2 or 3, while $Ar^2$ is an organic group of divalent or trivalent.)

(8)

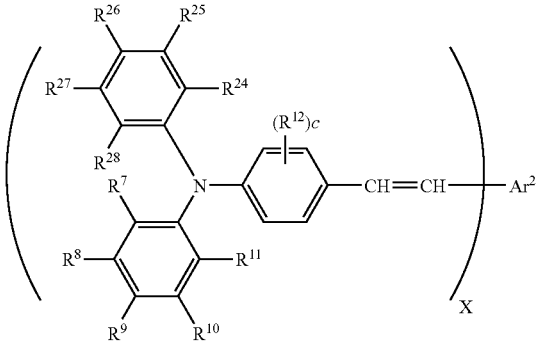

(In general formula (8), $R^7$ to $R^{12}$ and c are the same as the content of the general formula (2) wherein $R^{24}$ to $R^{28}$ are respectively independent and represent a hydrogen atom, a halogen atom, a substituted or unsubstituted alkyl group having 1 to 20 carbons, a substituted or unsubstituted alkenyl group having 2 to 20 carbons, a substituted or unsubstituted aryl group having 6 to 30 carbons, a substituted or unsubstituted aralkyl group having 6 to 30 carbons, or a hydrocarbon ring structure formed by two neighboring Rs of $R^7$ to $R^{11}$ or $R^{24}$ to $R^{28}$ being combined or condensed, and X is an integer of 2 or 3, while $Ar^2$ is an organic group of divalent or trivalent.)

Further in the stilbene derivative having a site represented by the general formula (7) or the general formula (8), $Ar^2$ is preferably an organic group represented by (a) to (c) of the following formula (9) when X is equal to 2, that is, an organic group of divalent.

Formula (9)

(a)

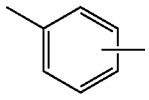

(b)

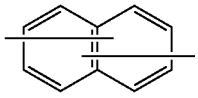

(c)

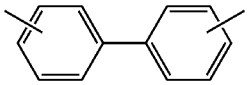

Further, in the stilbene derivative having a site represented by general formula (7) or the general formula (8), $Ar^2$ is preferably an organic group represented by the following formula (10) when X is equal to 3, that is, an organic group of trivalent.

(10)

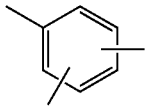

Further in a site represented by a general formula (2) or in a stilbene derivative represented by general formulae (7) to (8), an alkyl group which constitutes a substituent may be formed in a straight-chain state, in a branched-chain state or in a saturated hydrocarbon ring. Specifically, methyl, ethyl, n-propyl, isopropyl, n-butyl, isobutyl, s-butyl, t-butyl, n-pentyl, isopentyl, neopentyl, t-pentyl, hexyl, heptyl, octyl, cyclopenthyl, cyclohexyl, 2,6-dimethylcyclohexyl, and the like may be named. Further as an alkenyl group, for example, vinyl, 2,2-diphenyl-1-ethenyl, 4-phenyl-1,3-butadienyl, 1-propenyl, allyl and the like may be named. Such an alkenyl group may further include a substituent such as an aryl group and the like.

Further as an aryl group, for example, phenyl, naphthyl, biphenyl; tolyl, xylyl, mesityl, cumenyl, 2-ethyl-6-methylphenyl and the like may be named. The aryl group may further include a substituent such as an alkyl group, an alkoxy group and the like.

Further as an aralkyl group, for example, benzyl, phenethyl, 2,6-dimethylbenzyl and the like may be named. The aryl portion of the aralkyl group may further include an alkyl group, an alkoxy group and the like. As a halogen atom, for example, fluorine, chlorine, bromine, iodine and the like may be named.

Further, the stilbene derivative preferably includes, as the similar substituent, "a group containing carbon atoms" which is bonded with carbon atoms of the benzene ring in a single bond and "a group containing carbon atoms" which is bonded with nitrogen atoms in a single bond. Accordingly, besides the above-mentioned alkyl group, an alkenyl group, an aryl group, an aralkyl group and the like, an ether bond, a carbonyl group, a carboxyl group, an amino bond, a thioether bond, a hydrocarbon group having an azo atomic group and the like may be named.

Further, the stilbene derivative preferably includes, as the similar substituent, "a group containing nitrogen atoms" which is bonded with carbon atoms of the benzene ring in a single bond and "a group containing nitrogen atoms" which is bonded with nitrogen atoms in a single bond. Accordingly, for example, a nitro group, an amino group, an azo group and the like may be named. Further, as for the amino group and the azo group, they may further substituted with an alkyl group, an aryl group or the like.

Further, the stilbene derivative preferably includes, as the similar substituent, "a group containing oxygen atoms" which is bonded with carbon atoms of the benzene ring in a single bond and "a group containing oxygen atoms" which is bonded with nitrogen atoms in a single bond. Accordingly, for example, an alkoxy group, an aryloxy group, an aralkyloxy group and the like may be named. As the alkoxy group, for example, methoxy, ethoxy, n-propoxy, isopropoxy, n-butoxy, s-butoxy, t-butoxy, pentyloxy, hexyloxy, heptyloxy, octyloxy and the like may be named.

Further, the stilbene derivative preferably includes, as the similar substituent, "a group containing sulfur atoms" which is bonded with a carbon atom of the benzene ring in a single bond and "a group containing sulfur atoms" which is bonded with nitrogen atoms. Accordingly, for example, an alkylthio group, an arylthio group, an aralkyl group and the like may be named. Further, the aryl portion of the arylthio group and the aralkylthio group may be substituted with an alkyl group, an alkoxy group or the like.

Further, in a site represented by the general formula (2) and in the stilbene derivative represented by the general formulae (7) to (8), two alkyl groups or alkenyl groups which are substituted close to the carbon atom of the benzene ring may be bonded to each other to form a saturated or non-saturated hydrocarbon ring, for example, a naphthalene ring, an anthracene ring, a phenanthrene ring, an indan ring, a tetrahydronaphthalene ring or the like.

(3)-2 Specific Examples

Further, as a specific example of the hole transport agent, a chemical compound represented by the following formula (11) may be named.

Formula (11)

HTM-1

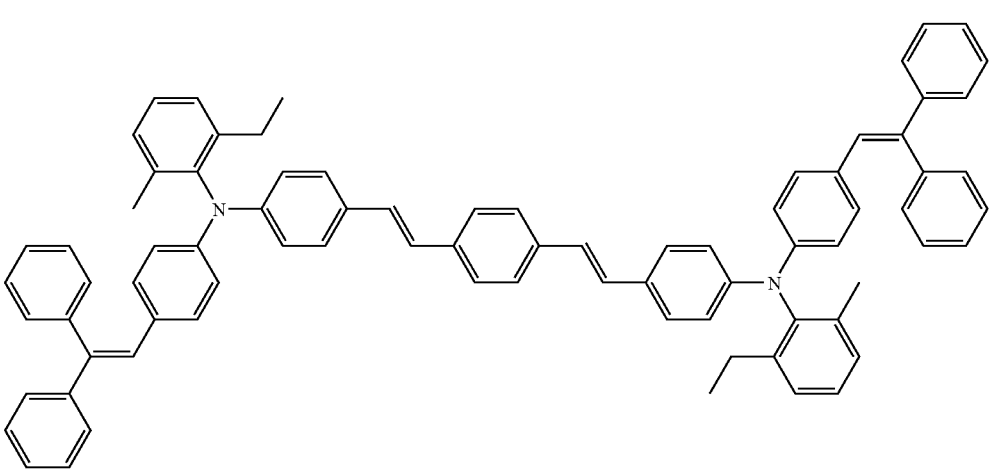

$C_{80}H_{68}N_2$
Mol. Wt.: 1057.41

-continued
HTM-2
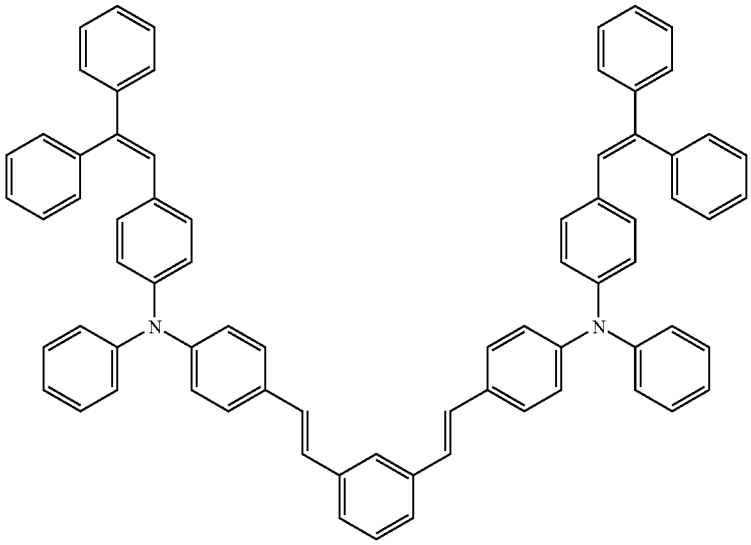
$C_{74}H_{56}N_2$
Mol. Wt.: 973.25
HTM-3
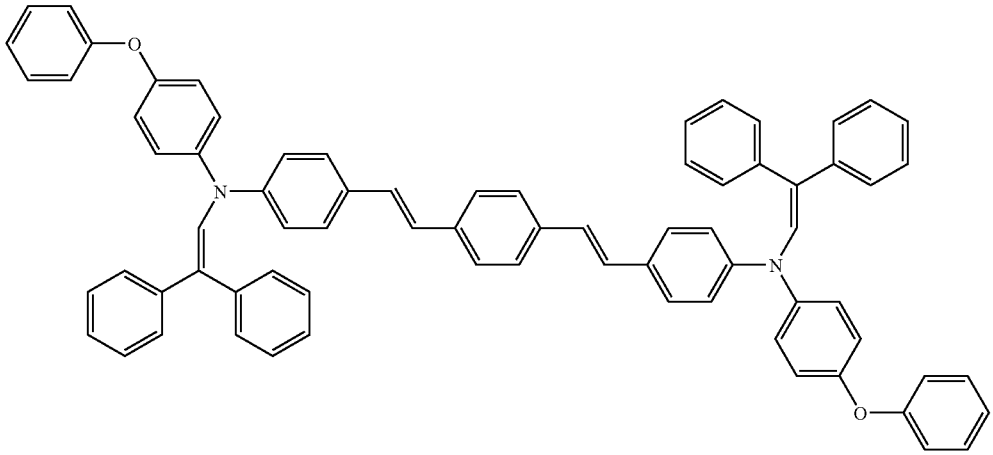
$C_{74}H_{56}N_2O_2$
Mol. Wt.: 1005.25

-continued
HTM-4
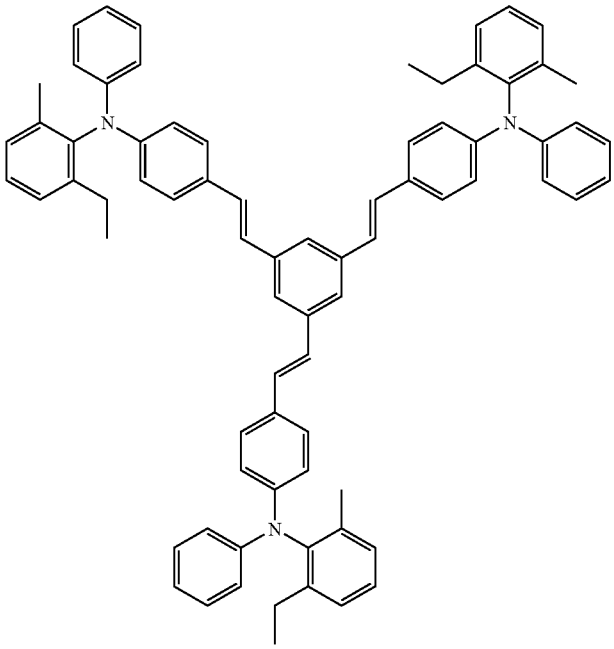
$C_{75}H_{69}N_3$
Mol. Wt.: 1012.37
HTM-5
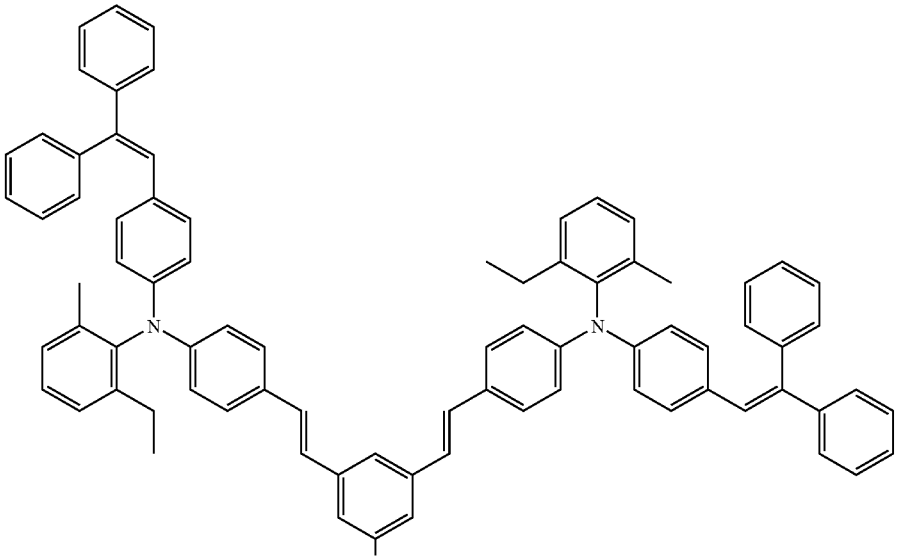

-continued
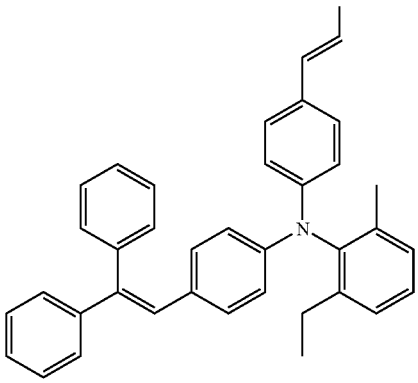
$C_{117}H_{99}N_3$
Mol. Wt.: 1547.03
HTM-6
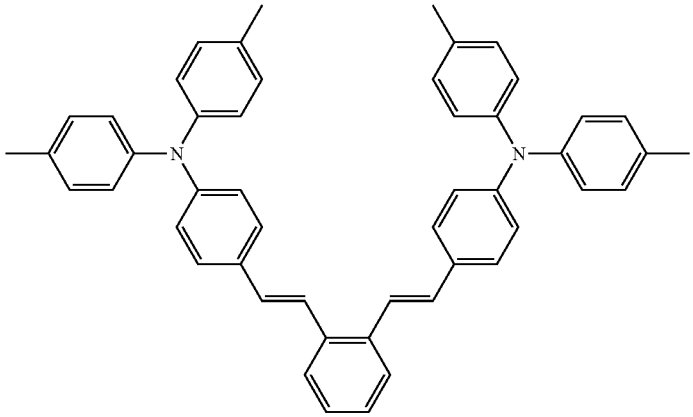
$C_{50}H_{44}N_2$
Mol. Wt.: 672.9
HTM-7
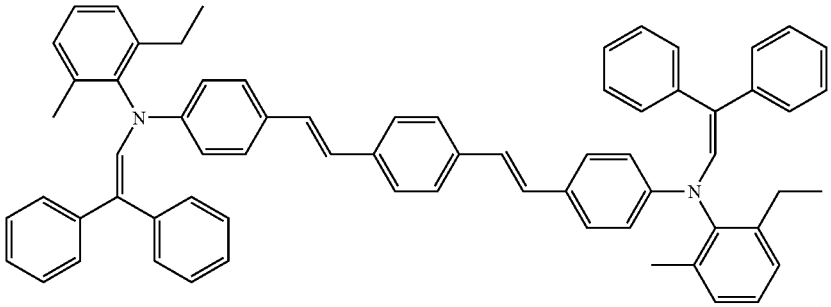
$C_{68}H_{60}N_2$
Mw: 905.22

-continued
HTM-8
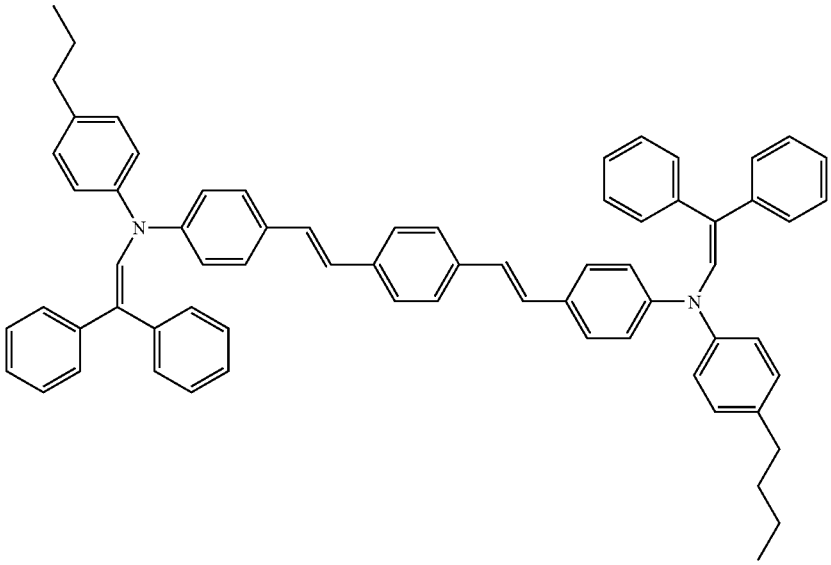
$C_{70}H_{64}N_2$
Mw: 933.27
HTM-9
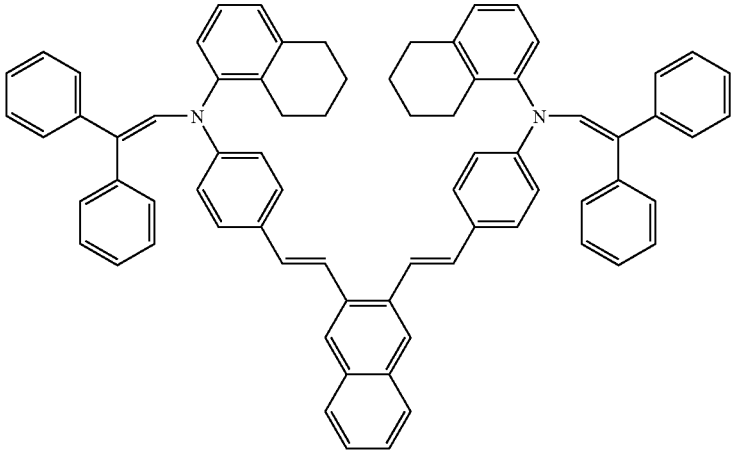
$C_{74}H_{62}N_2$
Mw: 979.30
HTM-10
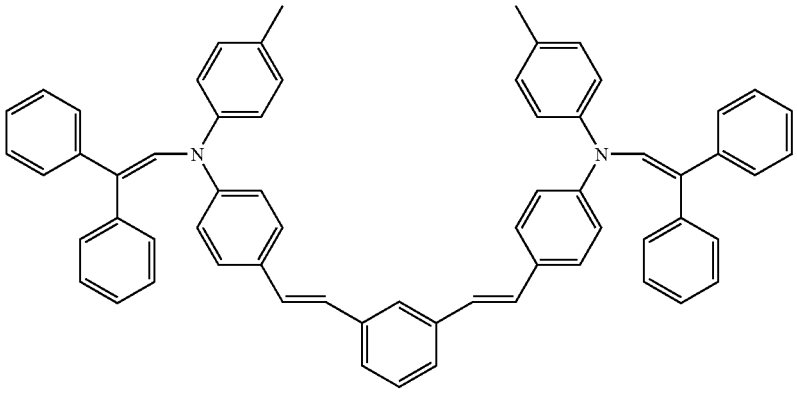
$C_{64}H_{52}N_2$
Mw: 849.11

-continued
HTM-11
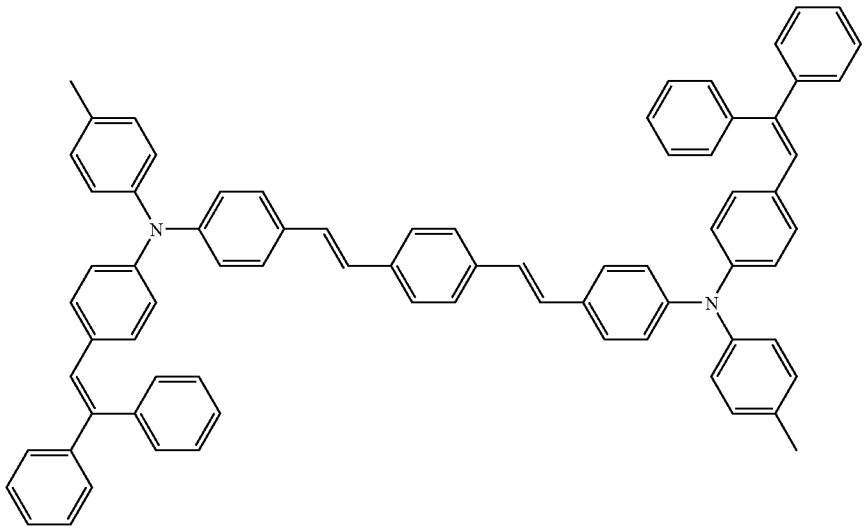
$C_{76}H_{60}N_2$
Mw: 1001.30
HTM-12
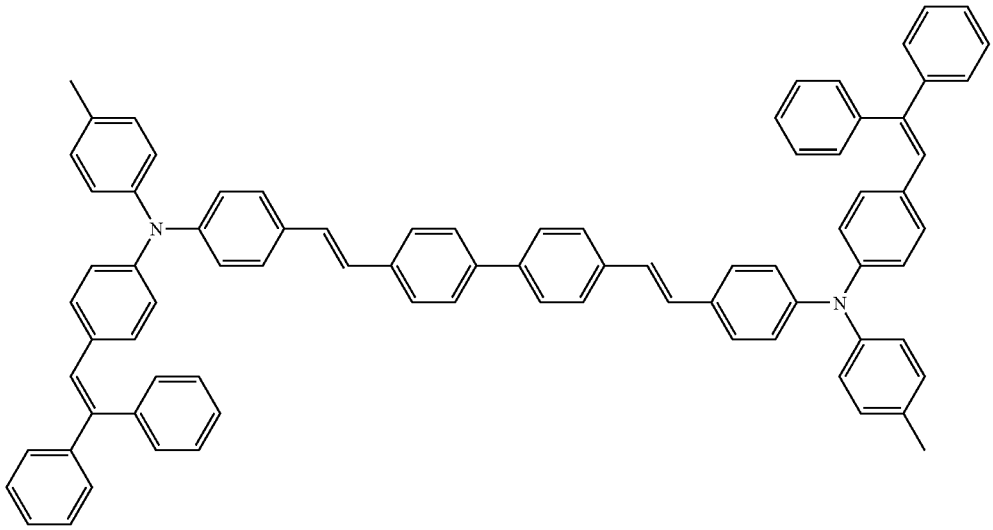
$C_{82}H_{64}N_2$
Mw: 1077.40
HTM-13
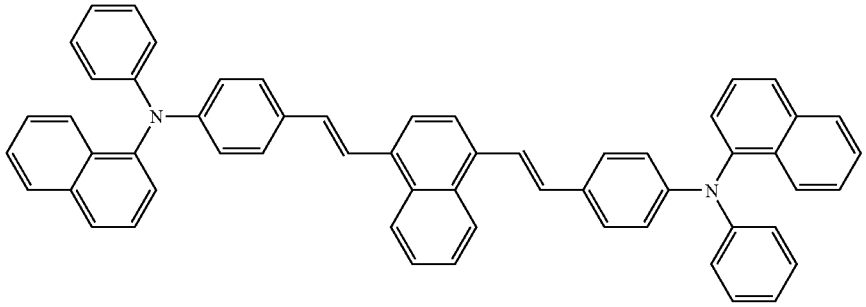
$C_{58}H_{42}N_2$
Mw: 766.97

-continued
HTM-14
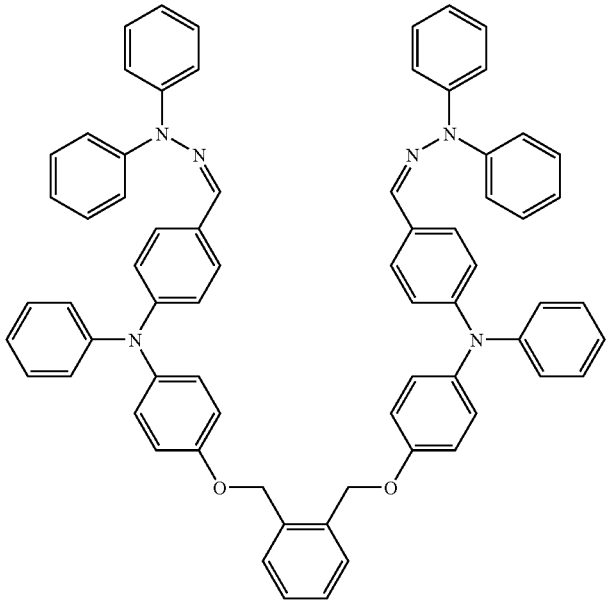
$C_{70}H_{56}N_6O_2$
Mw: 1013.23
HTM-15
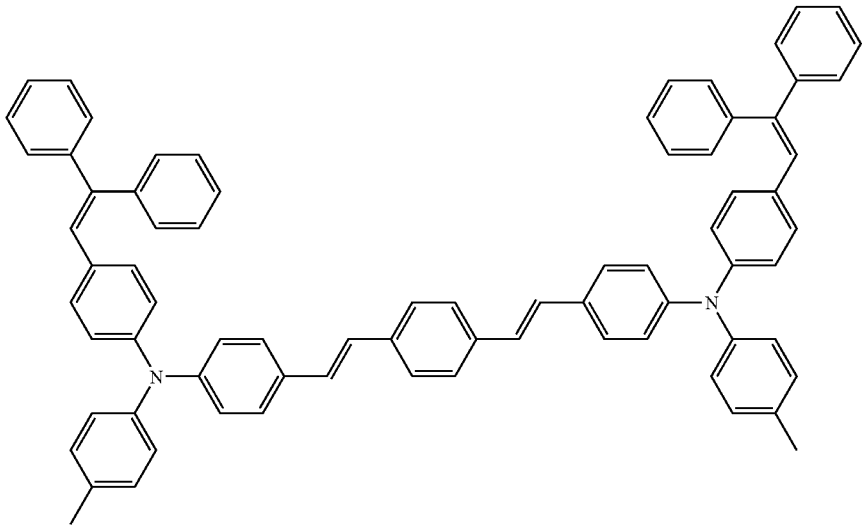
$C_{76}H_{60}N_2$
Mw: 1001.30

(3)-3 Addition Quantity

Also, it is preferable to set an addition quantity of the hole transport agent to a value which falls within a range of 10 to 80 parts by weight with respect to 100 parts by weight of the binding resin.

The reason is that when the addition quantity of hole transport agent assumes a value which is below 10 parts by weight, the sensitivity is lowered and there may arise a drawback in practical use. On the other hand, when the addition quantity of the hole transport agent exceeds 100 parts by weight, the hole transport agent is liable to be easily crystallized and hence, there may be a case that the formation of a film which has a proper thickness as the photoconductor becomes difficult.

Accordingly, it is more preferable to set the addition quantity of the hole transport agent to a value which falls within a range of 30 to 70 parts by weight.

(3)-4 Molecular Weight

Also, it is preferable to set a molecular weight of the hole transport agent to a value equal to or more than 900. The reason is that by setting the molecular weight of the hole transport agent to the value equal to or more than 900, the solvent resistance of the hole transport agent against a hydrocarbon solvent can be enhanced and hence, the elusion of the hole transport agent from the photosensitive layer can be effectively suppressed, and the deterioration of the sensitivity of the photosensitive layer can be also prevented.

However, when the molecular weight of the hole transport agent becomes excessively large, there may be a case that the dispersibility of the hole transport agent in the photosensitive layer is lowered or the hole transport function is lowered.

Accordingly, it is more preferable to set the molecular weight of the hole transport agent to a value which falls within a range of 1000 to 4000 and it is still more preferable to set the molecular weight of the hole transport agent to a value which falls within a range of 1000 to 2500.

Here, the molecular weight of the hole transport agent may be calculated based on the constitutional formula or based on a mass spectrum.

(4) Binding Resin (4)-1 Inorganic Value/Organic Value

Also, the present invention is characterized by the use of the binding resin which has the inorganic value/organic value (I/O value) equal to or more than 0.37.

Figure 7:
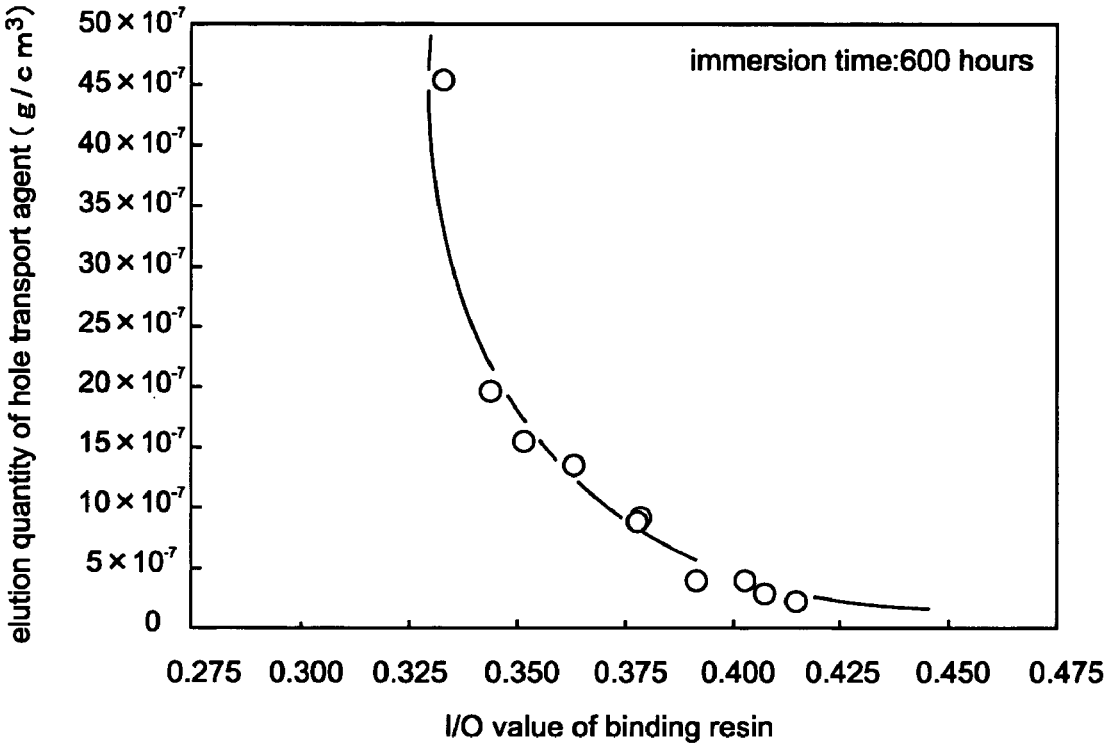
FIG. 7 is a view showing the relationship of an I/O value of the binding resin and an elution quantity of a hole transport agent.

The reason is that with the use of such binding resin, an interaction thereof with the electron transport agent having a specific I/O value is generated and hence, the dispersibility and the stability of the hole transport agent are enhanced. Accordingly, as shown in FIG. 7, the hole transport agent is hardly eluted into the hydrocarbon-type solvent having the large organicity.

Accordingly, even when the binding resin is used in a wet-developing image forming device which uses developing solution in which toner particles are dispersed in a hydrocarbon type solvent, it is possible to obtain the excellent solvent resistance, the durability and the excellent image characteristics (light potential).

However, when the I/O value of the binding resin becomes excessively large, the mixing ability with the electron transport agent and the solubility with the solvent may be lowered. Accordingly, it is more preferable to set the I/O value of the binding resin to a value which falls within a range of 0.375 to 1.7 and it is still more preferable to set the I/O value of the binding resin to a value which falls within a range of 0.38 to 1.6.

Here, polycarbonate resin which is expressed as Resin-1 and is described later is a typical example of binding resin which can be used in the prevent invention. The I/O value of the polycarbonate resin is calculated as follows.

(Organic Factor)

The organic factor includes 15.7 pieces of carbon atoms having organicity of 20.

The organic factor includes 0.85 pieces of Iso branches having organicity of −10.

Accordingly, the organic value becomes 305.5 (=20×15.7−10×0.85).

(Inorganic Factor)

The inorganic factor includes two pieces of benzene rings having inorganicity of 15.

The inorganic factor includes one piece of O—COO having inorganicity of 80.

The inorganic factor includes 0.15 pieces of CO having inorganicity of 65.

Accordingly, the inorganic value of the polycarbonate resin expressed as Resin-1 becomes 119.75 (=15×2+80+65×0.15) and the I/O value is obtained as 119.75/305.5=0.392.

The I/O value which is calculated described above indicates that as the I/O value becomes closer to 0, the organic compound becomes more non-polar (exhibiting the large hydrophobic property and organicity), while as the I/O value becomes larger, the organic compound becomes more polar (exhibiting the large hydrophilic property and inorganicity) organic compound.

Here, as the binding resin, provided that the I/O value is equal to or more than 0.37, it is possible to use various kinds of known resins. Among known resins, it is preferable to use at least one kind of resin selected from a group consisting of a polycarbonate resin, a polyester resin, a polyarylate resin, a polystyrene resin and a polymethacrylate resin from a viewpoint that properties such as the compatibility with the electron transport agent and the hole transport agent, the strength of the photosensitive layer, the abrasion resistance and the like can be further improved.

The reason is that with use of a polycarbonate resin, the binding resin is hardly eluted in the hydrocarbon type solvent and the biding resin exhibits the high oil repellency. Eventually, the interaction between the surface of the photosensitive layer and the above-mentioned hydrocarbon type solvent becomes small and hence, the change in appearance of the surface of the photosensitive layer can be reduced over a long period.

(4)-2 Viscosity Average Molecular Weight

It is also preferable to set the viscosity average molecular weight of the binding resin to a value which falls within a range of 40,000 to 80,000.

The reason is that with the use of such a binding resin having such a specific molecular weight, even when the photoconductor is immersed in the hydrocarbon type solvent used as a wet-type developer for a long period, it is possible to effectively provide the wet-developing electrophotographic photoconductor which exhibits a small elution quantity of the hole transport agent or the like and also exhibits excellent ozone resistance.

That is, when the viscosity average molecular weight of the binding resin, for example, polycarbonate resin assumes a value less than 40,000, there may be a case that the solvent resistance of the binding resin is remarkably lowered. On the other hand, when the viscosity average molecular weight of the binding resin, for example, polycarbonate resin exceeds 80,000, the ozone resistance of the binding resin may be remarkably lowered.

Accordingly, it is preferable to set the viscosity average molecular weight of the binding resin, for example, polycarbonate resin to a value which falls within a range of 50,000 to 79,000. It is still more preferable to set the viscosity average molecular weight of the binding resin, for example, polycarbonate resin to a value which falls within a range of 60,000 to 78,000.

Also, the viscosity average molecular weight of the polycarbonate resin (M) is calculated by obtaining a limit viscosity [η] using Ostwald viscometer and, then, by inputting [η] to the Schenell's formula $[\eta]=1.23\times10^{-4}M^{0.83}$. Here, [η] may be measured using a polycarbonate resin solvent obtained by dissolving polycarbonate resin in a dichloromethane solution which is used as the solvent such that the concentration (C) of the solvent becomes 6.0 g/dm$^3$ at a temperature of 20° C.

Hereinafter, the influence of the viscosity average molecular weight in the polycarbonate resin which is used as the binding resin is specifically explained in conjunction with FIG. 8 and FIG. 9.

Figure 8:
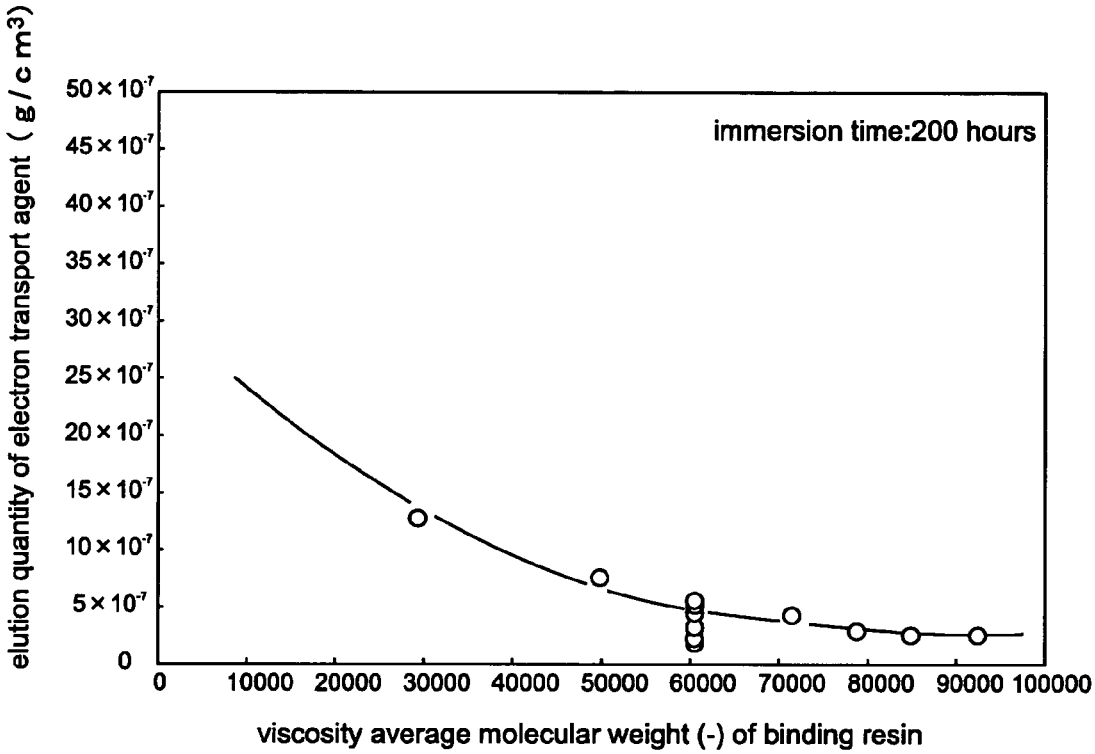
FIG. 8 is a view showing the relationship of a viscosity average molecular weight of the binding resin and an elution quantity of a hole transport agent.

Firstly, FIG. 8 shows the relationship between the viscosity average molecular weight of the binding resin and the elution quantity of the hole transport agent. In FIG. 8, the viscosity average molecular weight of the binding resin is taken on an axis of abscissas and an elution quantity (g/cm$^3$) of the hole transport agent after the wet-developing electrophotographic photoconductor is immersed in an isoparaffin solvent for 200 hours is taken on an axis of ordinates. It is understood from FIG. 8 that the elution quantity of the hole transport agent assumes a value equal to or less than $10.0\times10^{-7}$ g/cm$^3$ when the viscosity average molecular weight of the binding resin is equal to or more than 40,000 and the elution quantity of a hole transport agent assumes a value equal to or less than $5.0\times10^{-7}$ g/cm$^3$ when the viscosity average molecular weight of the binding resin is equal to or more than 60,000 and each wet-developing electrophotographic photoconductor exhibits the excellent solvent resistance.

Figure 9:
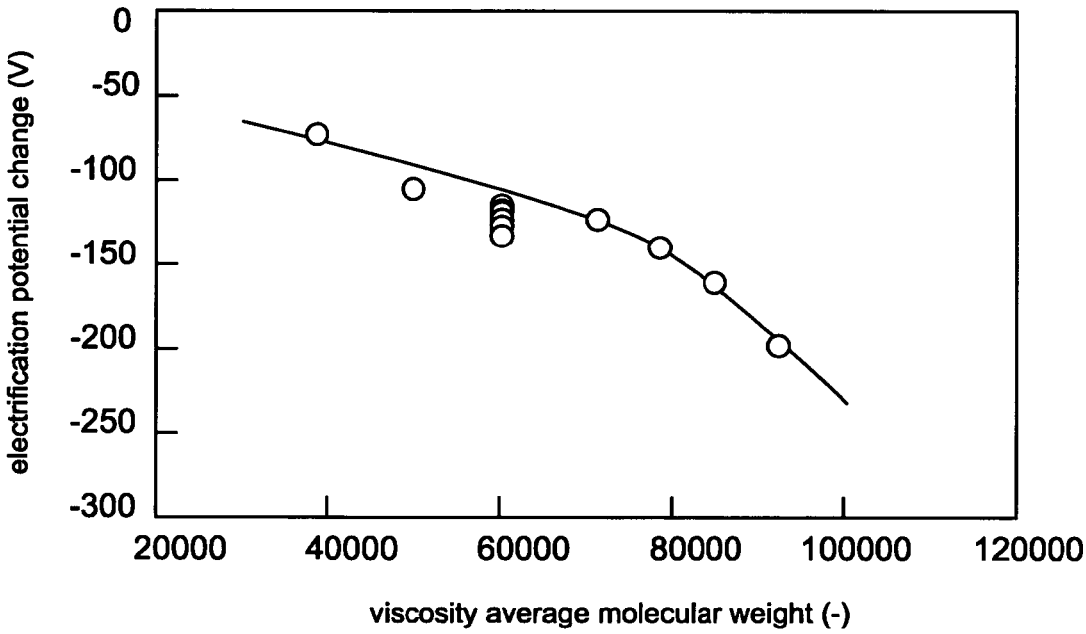
FIG. 9 is a view showing the relationship of a viscosity average molecular weight of the binding resin and an electrification potential change.

Further, FIG. 9 shows the relationship between the viscosity average molecular weight of the binding resin and the ozone resistance. In FIG. 9, the viscosity average molecular weight of the binding resin is taken on an axis of abscissas and a change quantity of an electrification potential obtained by the ozone resistance evaluation is taken on an axis of ordinates. Although the smaller the change quantity of the electrification potential, the ozone resistance is increased, it is possible to provide the photoconductor which generates no defects on an image provided that an absolute value of the change quantity of the electrification potential is equal to or less than 145V. Accordingly, it is understood from FIG. 9 that the larger the viscosity average molecular weight, the ozone resistance is lowered and, provided that the value of the viscosity average molecular weight of the binding resin falls within a range of 80,000 or less, the change quantity of the electrification potential is equal to or less than 141V and the photoconductor exhibits the excellent ozone resistance.

That is, it is understood from FIG. 8 and FIG. 9 that when the wet-developing electrophotographic photoconductor includes the binding resin having the viscosity average molecular weight of 40,000 to 80,000, it is possible to provide the wet-developing electrophotographic photoconductor which exhibits the excellent solvent resistance and the excellent ozone resistance.

Here, the ozone resistance evaluation is conducted to show the change of electrification potential with respect to an initial electrification potential by measuring a surface potential after applying an ozone exposure test to the wet-developing electrophotographic photoconductor. That is, the wet-developing electrophotographic photoconductor is mounted on Creage 7340 (produced by Kyocera Mita Co., Ltd) which is a digital copier, the wet-developing electrophotographic photoconductor is charged such that the wet-developing electrophotographic photoconductor possesses the charge of 800V, and the initial electrification potential ($V_0$) is measured. Subsequently, the wet-developing electrophotographic photoconductor is removed from the digital copier and is left in a dark place where the ozone concentration is adjusted to 10 ppm under conditions of room temperature and eight hours. Next, the state that the wet-developing electrophotographic photoconductor is left is completed and one hour elapses thereafter, the wet-developing electrophotographic photoconductor is again mounted on the digital copier and the surface potential after 60 seconds elapse from the start of charging is measured and the measured potential is set as a post-exposure surface potential ($V_E$). Then, a value which is obtained by subtracting the initial electrification potential ($V_0$) from the post-exposure surface potential ($V_E$) is set as the electrification potential change ($V_E$-$V_0$) in the ozone resistance evaluation.

(4)-3 Kinds

Further, with respect to the kind of the binding resin which is conventionally used as the wet-developing electrophotographic photoconductor, various kinds of polycarbonate resin can be used. For example, polycarbonate resins such as a bisphenol Z-type, a bisphenol ZC-type, a bisphenol C-type, a bisphenol A-type and the like can be named.

Further, as the binding resin, it is preferable to use the polycarbonate resin represented by a following general formula (1).

The reason is that the polycarbonate resin having such a structure is hardly eluted in the hydrocarbon type solvent and also exhibits the high oil repellency. Eventually, the interaction between the surface of the photosensitive layer and the above-mentioned hydrocarbon type solvent becomes small and hence, the change in appearance of the surface of the photosensitive layer can be reduced over a long period.

Here, "a" and "b" in the general formula (1) described later indicate mol ratios of copolymer components. For example, when "a" is 15 and "b" is 85, this implies that the mol ratio is 15:85. Such a mol ratio can be calculated using NMR, for example.

(1)

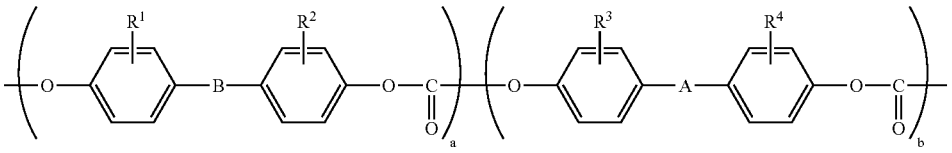

$0.05<a/(a+b)<0.6$ ($R^1$ to $R^4$ in the general formula (1) are respectively independent and represent a hydrogen atom, a halogen atom, a substituted or unsubstituted alkyl group having 1 to 20 carbons, a substituted or unsubstituted aryl group having 6 to 30 carbons and a substituted or unsubstituted halogenated alkyl group having 1 to 12 carbons, and A represents —O—, —S—, —CO—, —COO—, —$(CH_2)_2$—, —SO—, —$SO_2$—, —$CR^5R^6$—, —$SiR^5R^6$—, or —$SiR^5R^6$—O— ($R^5$ and $R^6$ are respectively independent and represent a hydrogen atom, a substituted or unsubstituted alkyl group having 1 to 8 carbons, a substituted or unsubstituted aryl group having 6 to 30 carbons, a trifluoromethyl group, or a cycloalkylidene having 5 to 12 carbons in which $R^5$ and $R^6$ form a ring and an alkyl group having 1 to 7 carbons may be included as a substituent group) and B represents single bond, —O— or —CO—.)

Further, with respect to the binding resin, it is preferable that $R^5$ and $R^6$ in the general formula (1) differ in kinds and are asymmetric from each other.

The reason is that such polycarbonate resin can further improve the compatibility with the hole transport agent and hence, even when the wet-developing electrophotographic photoconductor is immersed in the hydrocarbon-based solvent which is used as the developer for a long time, it is possible to provide the wet-developing electrophotographic photoconductor which exhibits the extremely small elution quantity of the hole transport agent.

Here, the arrangement that $R^5$ and $R^6$ are asymmetric from each other means that $R^5$ and $R^6$ assume the asymmetric relationship when viewed with the center element (for example, C in —$CR^5R^6$—) at A in the general formula (1) as the center of symmetry.

However, it is also preferable to use a resin other than the polycarbonate resin in combination with the polycarbonate resin. For example, it is possible to use a thermoplastic resin such as a polyarylate resin, a styrene-butadiene copolymer, a styrene-acrylonitrile copolymer, a styrene-maleic acid copolymer, an acrylic copolymer, a styrene-acrylic acid copolymer, a polyethylene resin, an ethylene-vinyl acetate copolymer, a chlorinated polyethylene resin, a poly vinyl chloride resin, a polypropylene resin, an ionomer resin, a vinyl chloride-vinyl acetate copolymer, an alkyd resin, a polyamide resin, a polyurethane resin, a polysulfone resin, a diallyl phthalate resin, a ketone resin, a polyvinyl butyral resin, a polyether resin, a cross-link thermosetting resin such as a silicone resin, an epoxy resin, a phenol resin, an urea-formaldehyde resin, a melamine resin or the others, a photo-curable resin such as an epoxy acrylate, an urethane acrylate.

Here, as a specific example of a binding resin having an I/O value of equal to or more than 0.37, a polycarbonate resin represented by the following formula (12) may be named.

Formula (12)

Resin-1

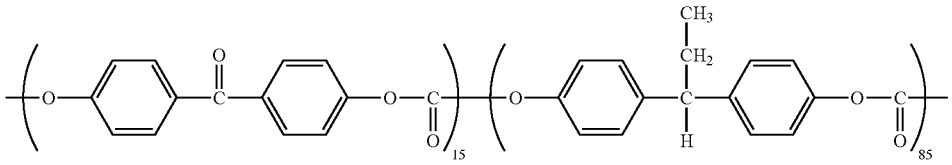

I/O value 0.392

Resin-2

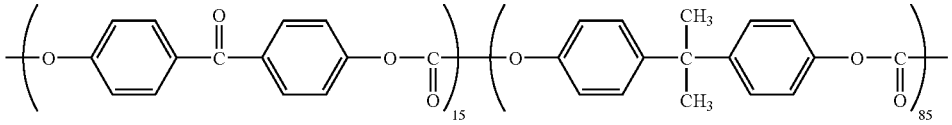

I/O value 0.403

Resin-3

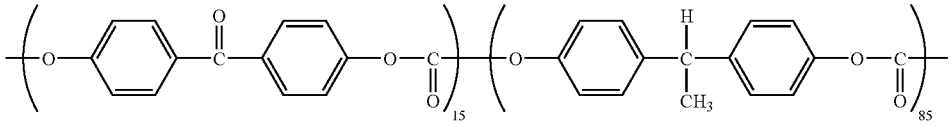

I/O value 0.415

Resin-4

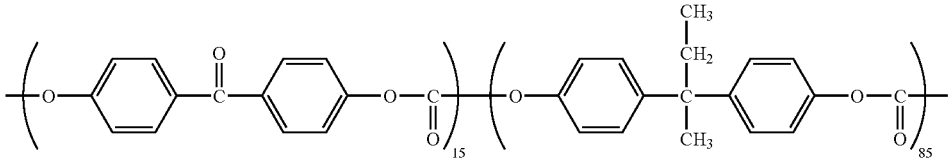

I/O value 0.381

Resin-5

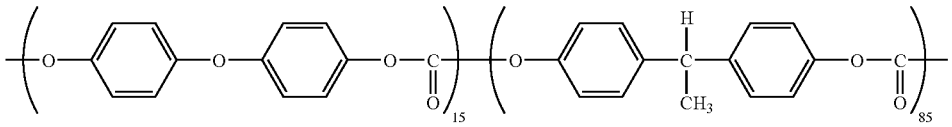

I/O value 0.396

-continued
Resin-6
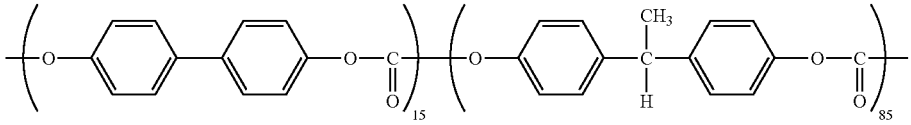
I/O value 0.385
Resin-7
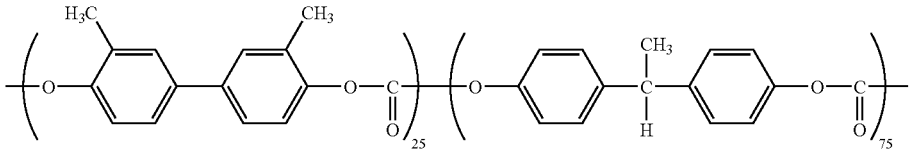
I/O value 0.376
Resin-8
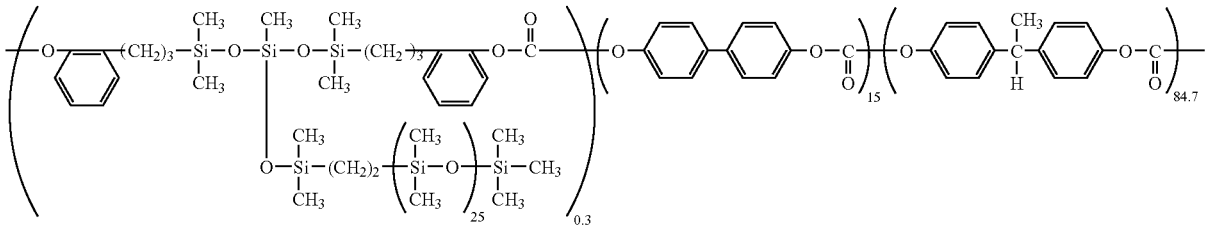
I/O value 0.385
Resin-9
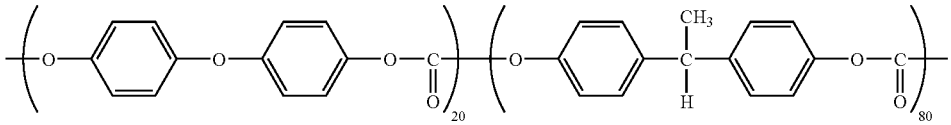
I/O value 0.401
Resin-10
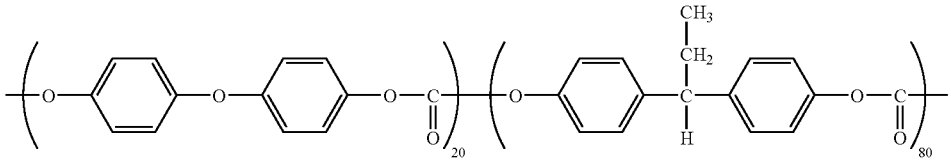
I/O value 0.380
Resin-11
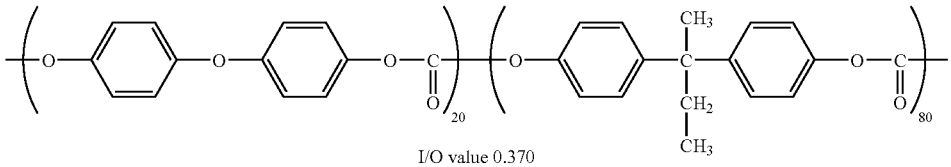
I/O value 0.370
Resin-12
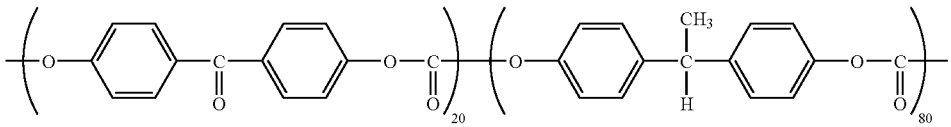
I/O value 0.427

-continued
Resin-13
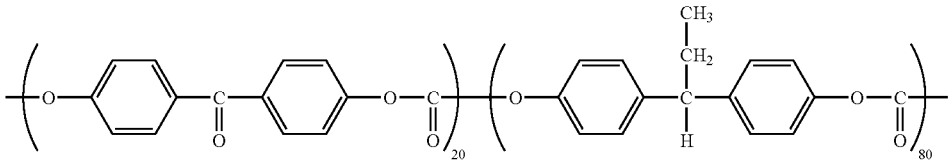
I/O value 0.405
Resin-14
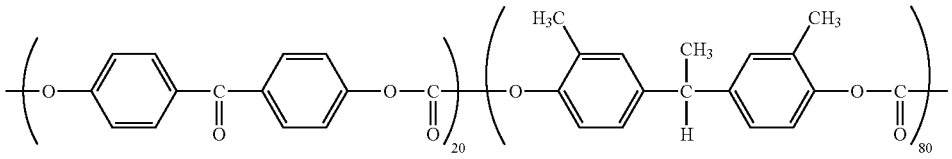
I/O value 0.384
Resin-15
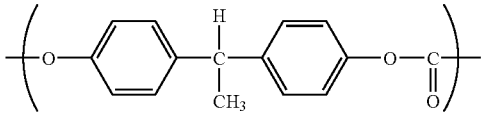
I/O value 0.379
Resin-16
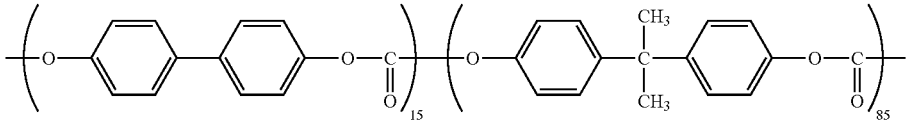
I/O value 0.374

(5) Charge Generating Agent

Further, as a charge generating agent which can be used for the wet-developing electrophotographic photoconductor of the present invention, a single kind or a combination of two or more kinds of various types of conventionally known charge generating agent such as, for example, a phthalocyanine type pigment; a disazo pigment; a disazo condensation pigment, a monoazopigment, a perilene pigment, a dithio keto pyrrolopyrrole pigment, a non-metal naphthalocyanine pigment, a metal naphtalocyanine pigment, a squaraine pigment, a trisazo pigment, an indigo pigment, an azulenium pigment, a cyanine pigment, a pyrylium salt, an anthanthrone-based pigment, a triphenylmethane type pigment, a threne-based pigment, a toluidine-based pigment, a pyrazoline pigment, a quinacridone-based pigment in combination may be named.

More specifically, a non-metal phthalocyanine (abbreviated to CGM-1), a titanyl phtalocyanine (abbreviated to TiOPc, CGM-2), a hydroxy gallium phthalocyanine (abbreviated to CGM-3), a chloro gallium phthalocyanine (abbreviated to CGM-4) which are represented by the following formulae (13) and the like may be named.

Formula (13)

CGM-1

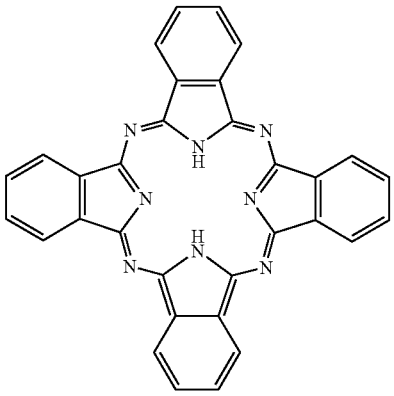

CGM-2

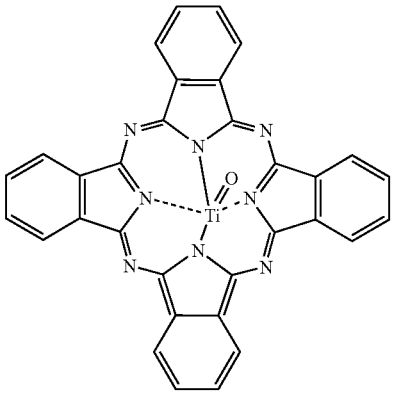

CGM-3

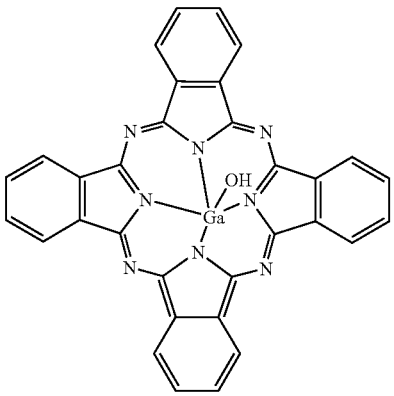

-continued

CGM-4

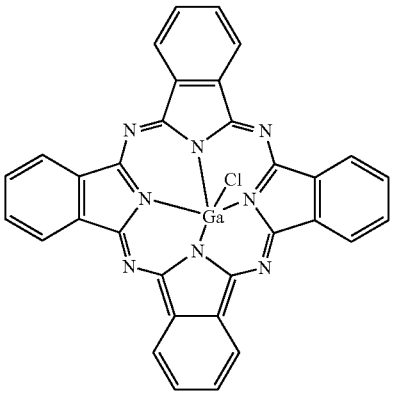

Further, it is preferable to set an addition quantity of the charge generating agent to a value which falls within a range of 0.2 to 40 parts by weight with respect to 100 parts by weight of the binding resin.

The reason is that when the addition quantity of a plurality of charge generating agents assumes a value below 0.2 parts by weight, it is difficult to obtain a sufficient quantum yield and hence, it is difficult to enhance the sensitivity, the electric characteristics, the stability and the like of the electrophotographic photoconductor. On the other hand, when the addition quantity of the plurality of charge generating agents assumes a value which exceeds 40 parts by weight, the extinction coefficient with respect to light having an absorption wavelength which falls in a red radiation region, an infrared radiation region or a near infrared radiation region is lowered and hence, the sensitivity, the electric characteristics, the stability and the like of the electrophotographic photoconductor are lowered correspondingly.

Accordingly, it is more preferable that the addition quantity of the charge generating agent is set to a value which falls within a range of 0.5 to 20 parts by weight with respect to 100 parts by weight of the binding resin.

(6) Other Additives

Further, in the photosensitive layer, in addition to the above-mentioned respective contents, it is possible to mix or blend the conventionally known various additives such as, for example, an antioxidant, a radical scavenger, a singlet quencher, a degradation inhibitor such as an ultraviolet ray absorbing agent, a softening agent, a plasticizer, a surface reforming agent, an extending agent, a thickener, a dispersion stabilizer, a wax, an acceptor, a donor and the like.

Further, to enhance the sensitivity of the photosensitive layer, it is possible to use a known sensitizer such as terphenyl, a halo naphthoquinone group, acenaphthylene, for example together with the charge generating agent. Still further, to enhance the dispersibility of the charge transport agent and the charge generating agent and the smoothness of the surface of the photosensitive layer, a surfactant, a leveling agent and the like may be used.

(7) Electrically Conductive Base Body

Further, in the electrophotographic photoconductor for the wet developing of the present invention, as the electrically conductive base body on which the photosensitive layer is formed, various materials having the electric conductivity can be used and it is sufficient that the substrate per se has the electric conductivity or a surface of the substrate has the electric conductivity.

As specific examples of such an electrically conductive base body, a metal single body made of iron, aluminum, copper, tin, platinum, silver, vanadium, molybdenum, chromium, cadmium, titan, nickel, palladium, indium, stainless steel, brass or the like; a plastic material to which the above-mentioned metal is vapor-deposited or laminated, a glass which is covered with aluminum iodide, tin oxide, indium oxide or the like; a resin base body in which electrically conductive fine particles such as carbon black are dispersed may be named.

Further, the electrically conductive base body may have any shapes such as a sheet-like shape or a drum-like shape corresponding to the structure of an image forming device to be used.

Further, the electrically conductive base body may have a surface thereof applied with an oxide film forming treatment or a resin film forming treatment. As the preferable oxide film forming treatment, for example, when the electrically conductive base body is made of aluminum or titan, an anodic oxidation coating (an anode oxide film) may be formed on the surface of the electrically conductive base body. Further, although the anodic oxidation film may be formed by performing the anodic oxidation treatment in the acid bath of chromic acid, sulfuric acid, oxalic acid, boric acid, sulfamic acid or the like, for example, it is especially preferable to perform the treatment in the sulfuric acid among the above-exemplified acid solutions. The method for performing the anodic oxidation treatment, the method for performing the degreasing treatment prior to the anodic oxidation treatment and the like are not specifically limited and these treatments may be performed in accordance with methods which are usually adopted.

Further, with respect to the resin coating treatment which is applied to the electrically conductive base body, it is possible to name a treatment in which a nylon resin, a phenol resin, a melamine resin, an alkyd resin, a polyvinyl acetal resin or the like is dissolved in a proper solvent and the resin-containing solvent is applied to a surface of the electrically conductive base body.

Further, as the resin material used in the resin coating treatment, particularly, a polyamide resin and a resol type phenol resin may be named.

(8) Manufacturing Method

Further, the wet-developing electrophotographic photoconductor of single-layer type is obtained such that the charge generating agent, the charge transport agent, the binding agent and other contents, when necessary, are dispersed or dissolved in a proper dispersion medium and a photosensitive-layer-forming applying liquid obtained in this manner is applied to the electrically conductive base body and is dried to form the photosensitive layer.

Further, it is preferable to set a thickness of the photosensitive layer obtained by applying the photosensitive-layer-forming applying liquid to a value which falls within a range of 5 to 100 μm. Particularly, it is preferable to set the thickness of the photosensitive layer obtained by applying the photosensitive-layer-forming applying liquid to a value which falls within a range of 10 to 50 μm.

Further, in forming the photosensitive layer by an coating method, the charge generating agent, the charge transport agent, the insoluble azo pigment, the binding resin and the like which are exemplified above are dispersed and mixed with a proper solvent using known means such as a roll mill, a ball mill, an at liter, a paint shaker, an ultrasonic dispersion machine or the like and a dispersion liquid prepared in this manner is applied to the electrically conductive base body using known means and is dried.

2. Stacked-type Photoconductor

Figure 10:
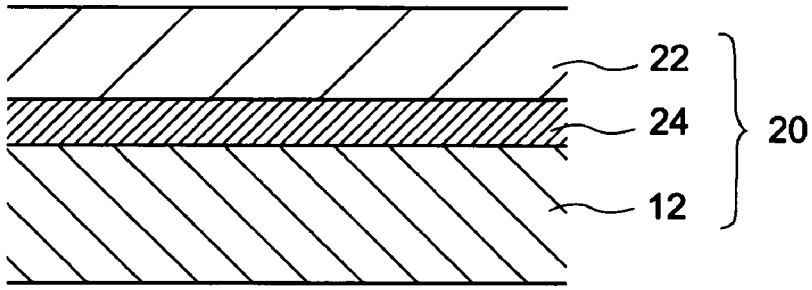
FIG. 10(*a*) and FIG. 10(*b*) are views for explaining the basic structure of a stacked-type photoconductor.
Figure 10:
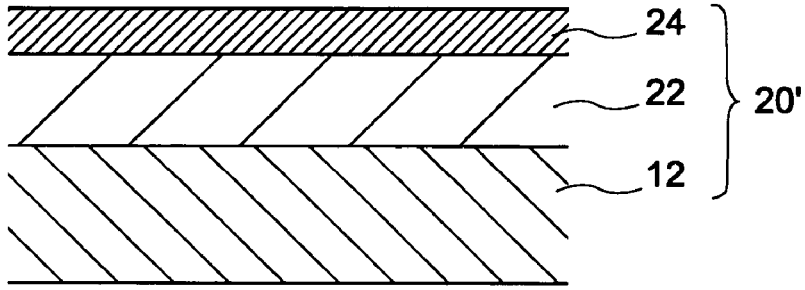

As shown in FIG. 10(*a*), in the wet-developing electrophotographic photoconductor, the stacked-type photoconductor 20 is prepared as follows. That is, a charge generating layer 24 which contains the charge generating agent is formed on the electrically conductive base body 12 using means such as vapor deposition or coating and, subsequently, a coating liquid which contains at least one kind of hole transport agent such as a stilbene derivative and a binding resin is applied to the charge generating layer 24 and is dried to form the charge transport layer 22.

Further, opposite to the above-mentioned structure, as shown in FIG. 10(*b*), it may possible to adopt a stacked-type photoconductor 20' in which the charge transport layer 22 is formed on the electrically conductive base body 12 and the charge generating layer 24 is formed on the charge transport layer 22.

Here, with respect to the charge generating agent, the hole transport agent, the electron transport agent, the binding agent and the like, the stacked-type photoconductor may fundamentally adopt the same contents as the single-layer-type photoconductor. However, in case of the stacked-type photoconductor, it is preferable to set an addition quantity of the charge generating agent to a value which falls within a range of 0.5 to 150 parts by weight with respect to 100 parts by weight of the binding resin which constitutes the charge generating layer.

Further, in the stacked-type photoconductor, whether the photoconductor becomes a positive charge type or a negative charge type is selected depending on the order of forming the charge generating layer and the charge transport layer and the kind of the charge transport agent used in the charge transport layer. For example, when the charge generating layer is formed on the electrically conductive base body and the charge transport layer is formed on the charge generating layer and, at the same time, the hole transport agent such as a stilbene derivative is used as the charge transport agent in the charge transport layer, the photoconductor becomes the negative charge type. In this case, the charge generating layer may contain the electron transport agent. Further, in case of the stacked-type wet-developing electrophotographic photoconductor, a residual potential of the photosensitive body is largely lowered and hence, it is possible to enhance the sensitivity of the photoconductor.

Here, with respect to the thickness of the photosensitive layer in the stacked-type photoconductor, a thickness of the charge generating layer is approximately 0.01 to 5 μm and, preferably approximately 0.1 to 3 μm, while a thickness of the charge transport layer is approximately 2 to 100 μm and, preferably approximately 5 to 50 μm.

Second Embodiment

The second embodiment is directed to a wet-developing electrophotographic photoconductor which forms a photosensitive layer containing at least a charge generating agent, an electron transport agent, a hole transport agent and a binding resin on an electrically conductive base body thereof, and sets a molecular weight of the electron transport agent to a value equal to or more than 600, and sets an inorganic value/organic value (I/O value) of the binding resin to 0.37 or more.

In this manner, by restricting the molecular weight of the electron transport agent to the value equal to or more than 600 while restricting the inorganic value/organic value (I/O value) of the binding resin to a given range, it is possible to enhance the dispersibility and the stability of the hole transport agent and, at the same time, it is possible to manufacture the wet-developing electrophotographic photoconductor in a stable manner.

To be more specific, by setting the molecular weight of the electron transport agent to the value equal to or more than 600, as shown in FIG. 5 and FIG. 6, the solvent resistance against the hydrocarbon solvent can be enhanced and hence, the elution of the electron transport agent from the photosensitive layer can be effectively suppressed and, at the same time, the repeating characteristic change in the photosensitive layer can be remarkably reduced.

However, when the molecular weight of the electron transport agent becomes excessively large, the dispersibility in the photosensitive layer of the electron transport agent may be lowed or the hole transport function may be lowered.

Accordingly, it is more preferable to set the molecular weight of the electron transport agent to the value which falls within a range of 600 to 2000. It is still more preferable to set the molecular weight of the electron transport agent to the value which falls within a range of 600 to 1000.

Here, the wet-developing electrophotographic photoconductor of the second embodiment may be basically considered as a modification of the wet-developing electrophotographic photoconductor of the first embodiment. That is, in the wet-developing electrophotographic photoconductor of the second embodiment, it is possible to use the binding resin, the electron transport agent, the charge generating agent and the like explained in conjunction with the first embodiment.

Further, as such an electron transport agent, specifically, a chemical compound represented by the general formula (14) may be named.

(14)

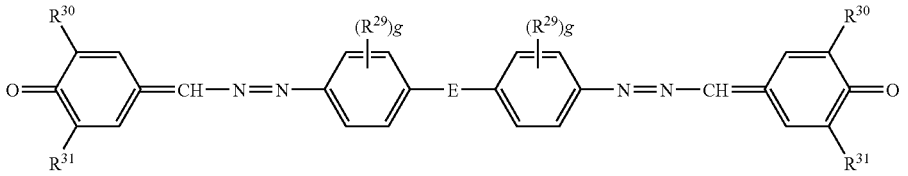

($R^{29}$ to $R^{31}$ in the general formula (14) are respectively independent and represent a halogen atom, a nitro group, an alkyl group having 1 to 8 carbons, an alkenyl group having 2 to 8 carbons or an aryl group having 6 to 18 carbons, g indicates an integer from 0 to 4, E represents alkylene group of a single bond and having 1 to 8 carbons, an alkylidene group having 2 to 8 carbons or divalent organic groups indicated by a general formula: —$R^{32}$—$Ar^3$—$R^{33}$— ($R^{32}$ and $R^{33}$ represent alkylene group having 1 to 8 carbons or alkylidene group having 2 to 8 carbons and $Ar^3$ represents an arylene group having 6 to 18 carbons.)

Further, as the electron transport agent, specific examples (ETM-9 to ETM-11) of the formula (14) and other preferred specific examples are shown in a following formula (15).

Formula (15)

ETM-9

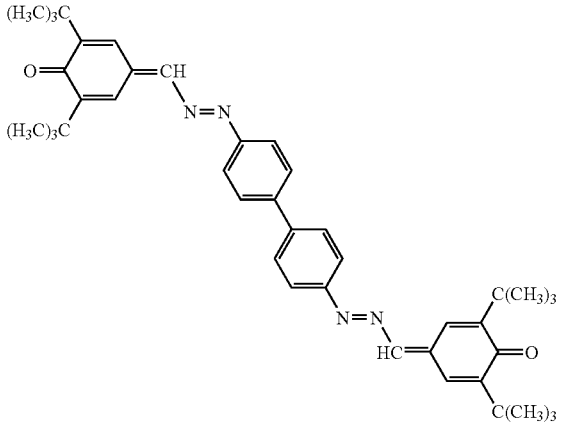

I/O value 0.334

$C_{42}H_{50}N_4O_2$
Mol. Wt.: 642.87

ETM-10

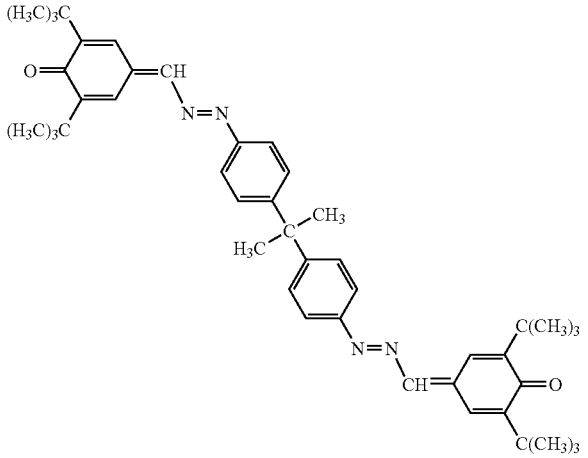

I/O value 0.318

$C_{45}H_{56}N_4O_2$
Mol. Wt.: 684.95

-continued

ETM-11

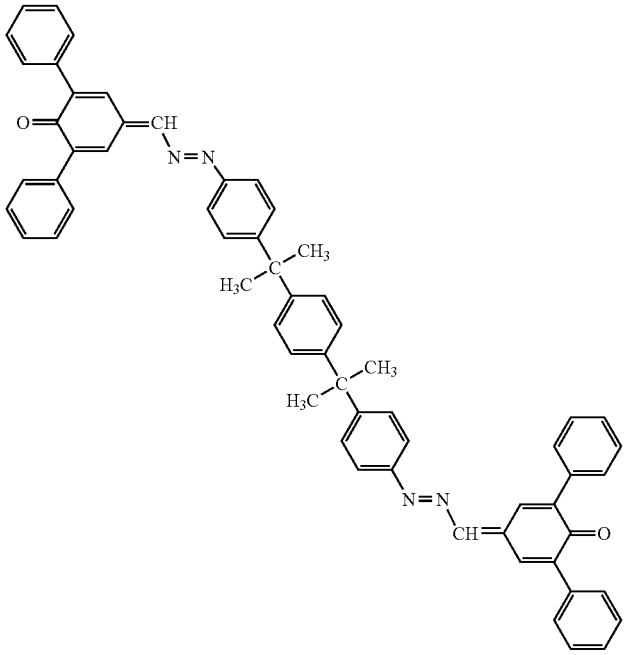

I/O value 0.274

$C_{62}H_{50}N_4O_2$
Mol. Wt.: 883.09

ETM-12

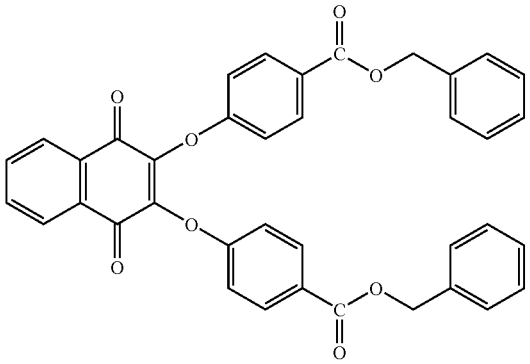

I/O value 0.540

$C_{38}H_{26}O_8$
Mol. Wt.: 610.61

Third Embodiment

Figure 11:
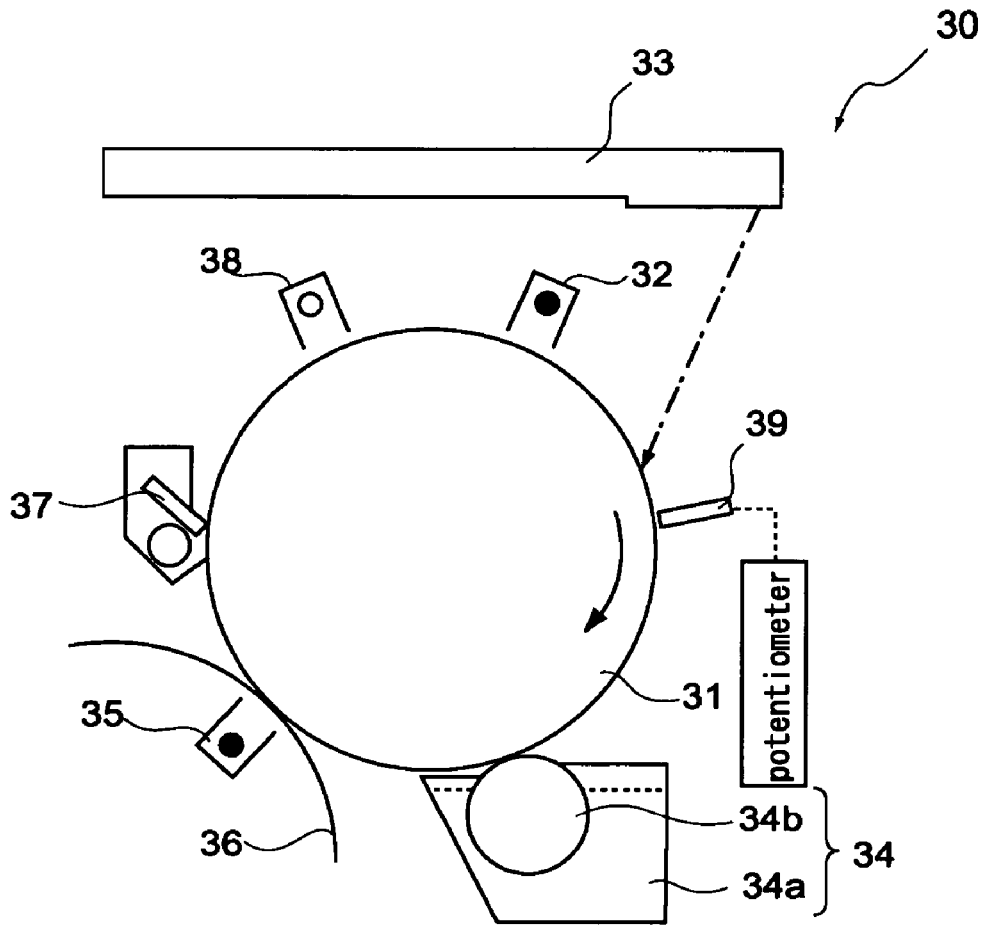
FIG. 11 is a view served for explaining a wet-developing image forming device.

The third embodiment is, as shown in FIG. 11, is directed to a wet-developing image forming device 30 which includes a wet-developing electrophotographic photoconductor (hereinafter also simply referred to as "photoconductor") 31 constituting the first embodiment and, at the same time, arranges a charger 32 for performing a charging step, an exposure light source 33 for performing an exposure step, a wet developing unit 34 for performing a developing step and a transfer unit 35 for performing a transfer step around the photoconductor 31. Further, the wet-developing image forming device 30 performs the image formation using a liquid developer 34*a* which is formed by dispersing toners in a hydrocarbon-based solvent.

Here, in the explanation made hereinafter with respect to the wet-developing image forming device, the explanation is made by assuming a case in which the single-layer photoconductor is used as the wet-developing electrophotographic photoconductor.

The photoconductor 31 is rotated at a fixed speed in the direction indicated by an arrow and an electrophotographic process is performed on a surface of the photoconductor 31 in the following order. To be more specific, the whole surface of the photoconductor 31 is charged by the charger 32 and, thereafter, a printed pattern is exposed using the exposure light source 33. Next, a toner developed image is formed using the wet developing unit 34 corresponding to the printed pattern, and the transfer of the toner to a transfer material (paper) 36 is performed using the transfer unit 35. Finally, the extra toner remaining on the photoconductor 31 is scraped off by a cleaning blade 37 and, at the same time, the charge of the photoconductor 31 is eliminated by a charge eliminating light source 38.

Here, the liquid developer 34*a* in which the toners are dispersed is conveyed by the developing roller 34*b*. By applying a given developing bias to the liquid developer 34*a*, the toners are attracted to a surface of the photoconductor 31 and the developing is performed on the photoconductor 31. Further, it is preferable to set the solid content concentration in the liquid developer 34*a* to a value which falls within a range of, for example, 5 to 25 weight %. Still further, as a liquid (toner dispersing solvent) used as a liquid developer 34*a*, it is preferable to use a hydrocarbon-based solvent or silicone-based oil.

Further, in the photoconductor 31, by setting ratios of inorganic value/organic value of the electron transport agent and the binding resin to given values respectively or by setting the molecular weight of the electron transport agent and the ratio of the inorganic value/organic value of the binding resin to given values, it is possible to obtain the single-layer-type wet-developing electrophotographic photoconductor which exhibits the excellent solvent resistance and the excellent sensitivity characteristics, wherein the photoconductor 31 can maintain the excellent image characteristics over a long time. That is, it is possible to manufacture the wet-developing electrophotographic photoconductor in a stable manner and, eventually, the photoconductor exhibits the favorable solvent resistance and hence, the charge transport agent (the hole transport agent or the electron transport agent) is hardly eluted in the hydrocarbon-based solvent whereby the favorable image is obtained.

EXAMPLE

Example 1

(1) Formation of Electrophotographic Photoconductor for the Wet Developing 4 parts by weight of an X type non-metal phthalocyianine (CGM-1) as a charge generating agent, 40 parts by weight of stilbene derivative (HTM-1) having a molecular weight of 1057.41 as a hole transport agent, 50 parts by weight of a compound (ETM-1) as an electron transport agent, 100 parts by weight of a polycarbonate resin (Resin-4, viscosity average molecular weight 50,000) as a binding resin and 0.1 parts by weight of dimethyl silicone oil (leveling agent) are, together with 750 parts by weight of a tetrahydrofuran (solvent), mixed and dispersed using the ultrasonic dispersion machine for 60 minutes and uniformly dissolved whereby an applying fluid for monolayer type photosensitive layer is formed. Then, this applying fluid is applied to the whole outer surface of the electrically conductive base body (almited aluminum stock tube) having a diameter of 30 mm and a length of 254 mm as a support body using a dip coating method and the hot-air drying of 130° C. is performed for 30 minutes whereby the single-layer-type wet-developing electrophotographic photoconductor having a film thickness of 22 μm is prepared.

(2) Evaluation (2)-1 Sensitivity Measurement

The light potential of the obtained wet-developing electrophotographic photoconductor is measured. That is, the wet-developing electrophotographic photoconductor is electrified to obtain a voltage of 700V using a drum sensitivity test machine (produced by GENTEC Ltd.) and, thereafter, the photoconductor is exposed to a monochromatic light (half-value width: 20 nm, light quantity: 1.0 $\mu J/cm^2$) having a wavelength of 780 nm which is taken out from light of a halogen lamp using a hand pulse filter. A potential is measured when 330 msec elapses after the exposure and the measured value is set as the initial sensitivity. Further, the whole photoconductor is immersed in Isoper L (isoparaffin-based solvent) under the condition of 25° C. and 600 hours. Thereafter, the wet-developing electrophotographic photoconductor is taken out from the Isoper liquid and the sensitivity of the photoconductor is measured in the same manner and the sensitivity difference between the initial sensitivity and the sensitivity after immersing in the Isoper L is calculated. The obtained result is shown in Table 2.

(2)-2 Evaluation of Solvent Resistance

The obtained monolayer-type wet-developing electrophotographic photoconductor is immersed in 500 ml of Isoper L (produced by Exxon Chemical (K.K)) which is used as a developer for wet developing under conditions that the whole surface of the photosensitive layer thereof is immersed in a dark place at a temperature of 20° C. for 600 hours in an open system. On the other hand, the hole transport agent is dissolved in the Isoper L while changing the concentration of the hole transport agent. Absorbency at an ultraviolet ray absorbing peak wavelength is measured in such a state and a concentration-absorbency calibration curve with respect to the hole transport agent is preliminarily prepared. Next, the ultraviolet ray absorption measurement is performed with respect to the wet-developing electrophotographic photoconductor immersed in the Isoper L, and an elution quantity of the hole transport agent is calculated based on the absorbency of the hole transport agent in the ultraviolet ray absorbing peak wavelength in view of the calibration curve. The obtained result is shown in Table 2.

(2)-3 Evaluation of Appearance

Further, with respect to the appearance of the wet-developing electrophotographic photoconductor after evaluation of the solvent resistance, the presence/non-presence of generation of the cracks is observed with naked eyes and the appearance evaluation is performed based on following criteria. The obtained result is shown in Table 2.

E (excellent): No change is found in appearance.
G (good): No remarkable change is found in appearance.
F (fair): Slight change is found in appearance.
B: (bad): Remarkable change is found in appearance.

Example 2

In the example 2, the wet-developing electrophotographic photoconductor is prepared in the same manner as the example 1 except for that 2 parts by weight of CGM-2 are used as the charge generating agent and 2 parts by weight of Pigment Orange 16 which constitutes a bis azo pigment represented by a following formula (16) is added for facilitating the dispersion of the charge generating agent and, thereafter, the prepared photoconductor is estimated. The obtained result is shown in Table 2.

(16)

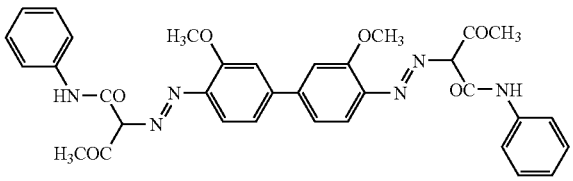

Examples 3 to 5

In the examples 3 to 5, the wet-developing electrophotographic photoconductors are prepared in the same manner as the example 1 except for that, in place of the electron transport agent (ETM-1) used in the example 1, electron transport agents (ETM-2 to ETM-4) which differ in the I/O value from the electron transport agent (ETM-1) used in the example 1 are used by the same quantity and, thereafter, the prepared photoconductors are estimated. The obtained result is shown in Table 2.

Comparison Examples 1 to 6

In the comparison examples 1 to 6, the wet-developing electrophotographic photoconductors are prepared in the same manner as the example 1 except for that, in place of the electron transport agent (ETM-1) used in the example 1, electron transport agents (ETM-13 to ETM-18) which are represented by a following formula (17) and whose I/O values are below 0.6 are used by the same quantity and, thereafter, the prepared photoconductors are estimated. The obtained result is shown in Table 2.

Formula (17)

ETM-13

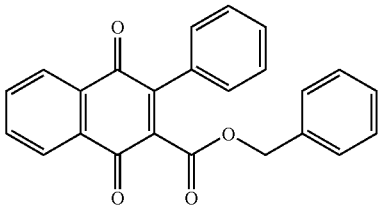

I/O value 0.583

$C_{24}H_{16}O_4$

Mol. Wt.: 368.38

ETM-14

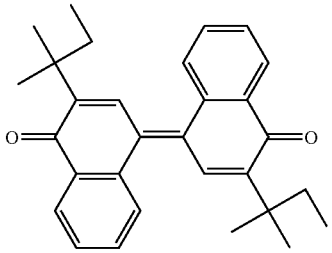

I/O value 0.450

$C_{30}H_{32}O_2$

Mol. Wt.: 424.57

ETM-15

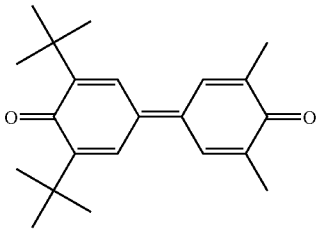

I/O value 0.405

$C_{22}H_{28}O_2$

Mol. Wt.: 324.46

-continued

ETM-16

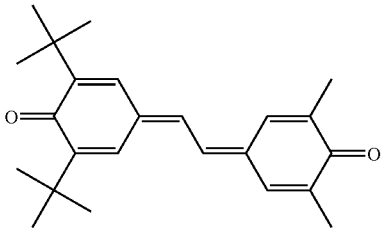

I/O value 0.373

$C_{24}H_{30}O_2$

Mol. Wt.: 350.49

ETM-17

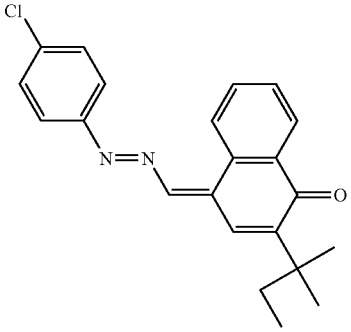

I/O value 0.363

$C_{22}H_{21}ClN_2O$

Mol. Wt.: 364.87

ETM-18

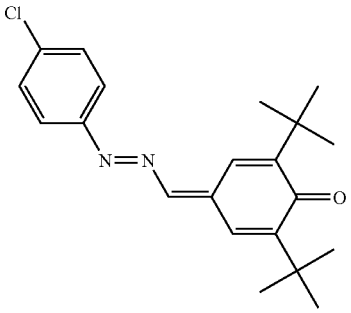

I/O value 0.326

$C_{21}H_{25}ClN_2O$

Mol. Wt.: 356.89

TABLE 2

| | Charge | Electron Transport Agent | | Light | Elution | Sensitivity | |
|---|---|---|---|---|---|---|---|
| | Generating Agent | Kinds | I/O Value | Potential (V) | Quantity (g/cm$^3$) | Change (V) | Drum Appearance |
| Example 1 | CGM-1 | ETM-1 | 0.917 | 99 | $4.10 \times 10^{-7}$ | +2 | E |
| Example 2 | CGM-2 | | | 94 | $3.86 \times 10^{-7}$ | +1 | E |
| Example 3 | CGM-1 | ETM-2 | 0.670 | 105 | $3.25 \times 10^{-7}$ | +0 | E |
| Example 4 | | ETM-3 | 0.636 | 104 | $4.05 \times 10^{-7}$ | −1 | E |

TABLE 2-continued

| | Charge | Electron Transport Agent | | Light | Elution | Sensitivity | |
|---|---|---|---|---|---|---|---|
| | Generating Agent | Kinds | I/O Value | Potential (V) | Quantity ($g/cm^3$) | Change (V) | Drum Appearance |
| Example 5 | | ETM-4 | 0.620 | 109 | $4.87 \times 10^{-7}$ | +4 | E |
| Comparison Example 1 | CGM-1 | ETM-13 | 0.583 | 101 | $8.56 \times 10^{-7}$ | +15 | G |
| Comparison Example 2 | | ETM-14 | 0.450 | 94 | $12.60 \times 10^{-7}$ | +4 | F |
| Comparison Example 3 | | ETM-15 | 0.405 | 113 | $15.10 \times 10^{-7}$ | +0 | F |
| Comparison Example 4 | | ETM-16 | 0.373 | 96 | $28.40 \times 10^{-7}$ | +13 | F |
| Comparison Example 5 | | ETM-17 | 0.363 | 98 | $31.60 \times 10^{-7}$ | +26 | F |
| Comparison Example 6 | | ETM-18 | 0.326 | 107 | $25.10 \times 10^{-7}$ | +24 | F |

E: Excellent
G: Good
F: Fair
B: Bad

Examples 6 to 11

In the examples 6 to 11, in the same manner as the example 1 except for that equal quantity of binding resins having different I/O value (Resin-1 to 3, 5, 15, 16) are used in place of the binding resin (Resin-4) used in the example 1, the wet-developing electrophotographic photoconductor is formed and evaluated. The obtained result is shown in Table 3.

Comparison Example 7 to 10

In the comparison examples 7 to 10, in the same manner as the example 1 except for that equal quantity of binding resins having I/O value less than 0.37 and represented by the following formulae (18) (Resin-17, 18, 19, 20) are used in place of the binding resin (Resin-4) used in the example 1, the wet-developing electrophotographic photoconductor is formed and evaluated. The obtained result is shown in Table 3.

Formula (18)

Resin-17

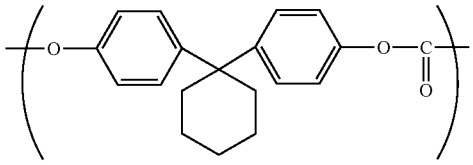

I/O value 0.333

Resin-18

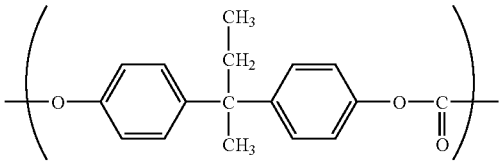

I/O value 0.344

Resin-19

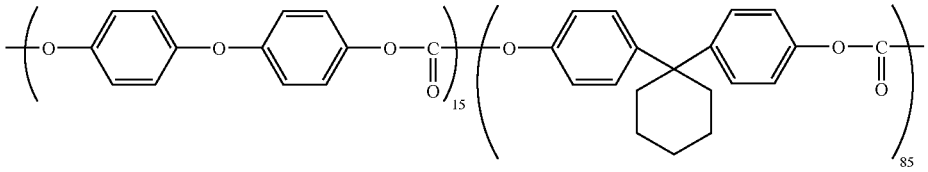

I/O value 0.352

Resin-20

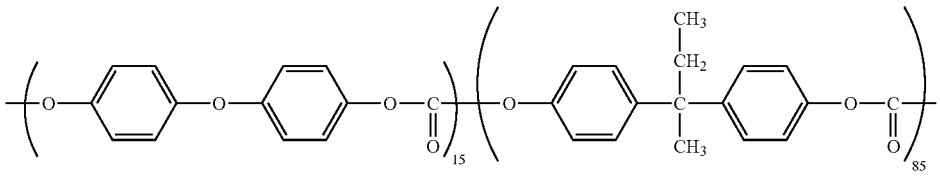

I/O value 0.363

TABLE 3

| | Binding Resin | | | Light | Elution | Sensitivity | |
|---|---|---|---|---|---|---|---|
| | Kinds | Molecular Weight | I/O Value | Potential (V) | Quantity (g/cm$^3$) | Change (V) | Drum Appearance |
| Example 6 | Resin-3 | 49800 | 0.415 | 104 | $2.26 \times 10^{-7}$ | −1 | E |
| Example 7 | Resin-5 | 51000 | 0.396 | 103 | $3.02 \times 10^{-7}$ | +1 | E |
| Example 8 | Resin-2 | 50000 | 0.403 | 105 | $3.99 \times 10^{-7}$ | +0 | G |
| Example 9 | Resin-1 | 49000 | 0.392 | 104 | $3.99 \times 10^{-7}$ | +4 | E |
| Example 10 | Resin-15 | 50500 | 0.379 | 101 | $9.12 \times 10^{-7}$ | +5 | G |
| Example 11 | Resin-16 | 51000 | 0.374 | 99 | $8.85 \times 10^{-7}$ | +2 | G |
| Comparison Example 7 | Resin-20 | 48500 | 0.363 | 105 | $13.50 \times 10^{-7}$ | +12 | F |
| Comparison Example 8 | Resin-19 | 49000 | 0.352 | 102 | $15.50 \times 10^{-7}$ | +11 | B |
| Comparison Example 9 | Resin-18 | 50000 | 0.344 | 94 | $19.80 \times 10^{-7}$ | +26 | B |
| Comparison Example 10 | Resin-17 | 50500 | 0.333 | 96 | $45.20 \times 10^{-7}$ | +46 | B |

E: Excellent
G: Good
F: Fair
B: Bad

Examples 12 to 29, Comparison Example 11

In the examples 12 to 29 and the comparison example 11, binding resins (Resin-6, 7, 8) are used in place of the binding resin (Resin-4) used in the example 1, ETM-1, 8, 10, 12 are used as electron transport agents, hole transport agents (HTM-6 to 14) are used in place of the hole transport agent (HTM-1), CGM-1 to 4 are used as charge generating agents and, in the same manner as the example 1, the wet-developing electrophotographic photoconductors are respectively formed as shown in Table 4 and, further, the immersed times of respective photoconductors are changed from 600 hours to 2000 hours and evaluated in the same manner as the example 1. The obtained result is shown in Table 4.

TABLE 4

| | Binding Resin | | | Charge | Hole | Electron | Elution | Initial | Sensitivity | |
|---|---|---|---|---|---|---|---|---|---|---|
| | Kinds | Molecular Weight | I/O Value | Generating Agent | Transport Agent | Transport Agent | Quantity (g/cm$^3$) | Sensitivity (V) | Change (V) | Drum Appearance |
| Example 12 | Resin-6 | 50,000 | 0.385 | CGM-1 | HTM-7 | ETM-1 | $2.1 \times 10^{-7}$ | 100 | 0 | E |
| Example 13 | Resin-6 | 50,000 | 0.385 | CGM-2 | HTM-7 | ETM-1 | $2.1 \times 10^{-7}$ | 87 | −1 | E |
| Example 14 | Resin-6 | 50,000 | 0.385 | CGM-3 | HTM-7 | ETM-1 | $1.8 \times 10^{-7}$ | 95 | 0 | E |
| Example 15 | Resin-6 | 50,000 | 0.385 | CGM-4 | HTM-7 | ETM-1 | $2.0 \times 10^{-7}$ | 110 | 0 | E |
| Example 16 | Resin-6 | 50,000 | 0.385 | CGM-1 | HTM-1 | ETM-1 | $1.0 \times 10^{-7}$ | 99 | −1 | E |
| Example 17 | Resin-6 | 50,000 | 0.385 | CGM-1 | HTM-7 | ETM-8 | $3.2 \times 10^{-7}$ | 89 | +2 | E |
| Example 18 | Resin-6 | 50,000 | 0.385 | CGM-1 | HTM-7 | ETM-10 | $3.3 \times 10^{-7}$ | 107 | +2 | G |
| Example 19 | Resin-6 | 50,000 | 0.385 | CGM-1 | HTM-7 | ETM-12 | $1.8 \times 10^{-7}$ | 105 | +1 | E |
| Example 20 | Resin-7 | 49,200 | 0.376 | CGM-1 | HTM-7 | ETM-1 | $2.0 \times 10^{-7}$ | 101 | −2 | E |
| Example 21 | Resin-8 | 50,000 | 0.386 | CGM-1 | HTM-7 | ETM-1 | $1.9 \times 10^{-7}$ | 103 | 0 | E |
| Example 22 | Resin-6 | 50,000 | 0.385 | CGM-1 | HTM-3 | ETM-1 | $1.3 \times 10^{-7}$ | 101 | 0 | E |
| Example 23 | Resin-6 | 50,000 | 0.385 | CGM-1 | HTM-8 | ETM-1 | $2.0 \times 10^{-7}$ | 99 | −1 | E |
| Example 24 | Resin-6 | 50,000 | 0.385 | CGM-1 | HTM-9 | ETM-1 | $1.5 \times 10^{-7}$ | 112 | +1 | E |
| Example 25 | Resin-6 | 50,000 | 0.385 | CGM-1 | HTM-10 | ETM-1 | $3.0 \times 10^{-7}$ | 104 | +3 | G |
| Example 26 | Resin-6 | 50,000 | 0.385 | CGM-1 | HTM-11 | ETM-1 | $1.4 \times 10^{-7}$ | 98 | +2 | E |
| Example 27 | Resin-6 | 50,000 | 0.385 | CGM-1 | HTM-12 | ETM-1 | $1.4 \times 10^{-7}$ | 96 | −1 | E |
| Example 28 | Resin-6 | 50,000 | 0.385 | CGM-1 | HTM-13 | ETM-1 | $3.5 \times 10^{-7}$ | 105 | +4 | G |
| Example 29 | Resin-6 | 50,000 | 0.385 | CGM-1 | HTM-6 | ETM-1 | $4.0 \times 10^{-7}$ | 106 | +4 | G |
| Comparison Example 11 | Resin-6 | 50,000 | 0.385 | CGM-1 | HTM-14 | ETM-1 | $2.9 \times 10^{-7}$ | 210 | +3 | F |

E: Excellent
G: Good
F: Fair
B: Bad

Examples 30 to 34

In the examples 30 to 34, in the same manner as the example 1 except for that different kinds of hole transport agents (HTM-2 to 6) having the equal quantity as the hole transport agent (HTM-1) of the example 1 are used in place of the hole transport agent (HTM-1) used in the example 1, the wet-developing electrophotographic photoconductor is formed and evaluated. The obtained result is shown in Table 5.

TABLE 5

| | Hole Transport Agent | Light Potential (V) | Elution Quantity ($g/cm^3$) | Sensitivity Change (V) | Drum Appearance |
|---|---|---|---|---|---|
| Example 30 | HTM-2 | 110 | $4.51 \times 10^{-7}$ | +0 | E |
| Example 31 | HTM-3 | 103 | $4.06 \times 10^{-7}$ | +2 | E |
| Example 32 | HTM-4 | 121 | $4.15 \times 10^{-7}$ | +1 | E |
| Example 33 | HTM-5 | 104 | $2.12 \times 10^{-7}$ | −1 | E |
| Example 34 | HTM-6 | 108 | $4.99 \times 10^{-7}$ | +3 | G |

E: Excellent
G: Good
F: Fair
B: Bad

Example 35

In the example 35, 3 parts by weight of an X type non-metal phthalocyanine (CGM-1) as a charge generating agent, 45 parts by weight of stilbene derivative (HTM-15) having a molecular weight of 1001.3 as a hole transport agent, 55 parts by weight of compound (ETM-5) as an electron transport agent, 100 parts by weight of a polycarbonate resin (Resin-3, viscosity average molecular weight 45,000) as a binding resin and 0.1 parts by weight of dimethyl silicone oil (leveling agent) are, together with 750 parts by weight of a tetrahydrofuran (solvent), mixed and dispersed using the ultrasonic dispersion machine for 60 minutes and uniformly dissolved whereby an applying fluid for monolayer type photosensitive layer is formed. Then, this applying fluid is applied to the whole outside surface of electrically conductive base body (almited aluminum stock tube) having a diameter of 30 mm and a length of 254 mm as a support body using a dip coating method and the hot-air drying is performed at a temperature of 140° C. for 20 minutes whereby the wet-developing electrophotographic photoconductor having a single photosensitive layer having a film thickness of 20 μm is formed.

(1) Evaluation (1)-1 Measurement of Sensitivity

The light potential in the obtained wet-developing electrophotographic photoconductor is measured. That is, the wet-developing electrophotographic photoconductor is electrified to have a voltage of 850V using a drum sensitivity test machine (manufactured by GENTEC Ltd) and, thereafter, the monochromatic light (half-value width: 20 nm, light quantity: 1.0 $\mu J/cm^2$) having a wavelength of 780 nm which is taken out from the halogen lamp light using a hand pulse filter is exposed. The potential is measured when 500 msec elapses after the exposure, and the measured value constitutes the light potential (V). The obtained result is shown in Table 6.

(1)-2 Evaluation of Solvent Resistance

The obtained monolayer-type wet-developing electrophotographic photoconductor is immersed in 500 ml of MORESCO WHITE P-40 (produced by Matsumura Oil Research Corp.) which is used as a developer of wet developing such that the whole surface of the photosensitive layer thereof is immersed under conditions of temperature of 20° C. and 200 hours in an open system and in a dark place. On the other hand, the density of the electron transport agent is changed and the electron transport agent is dissolved in the MORESCO WHITE P-40. Absorbency in the ultraviolet ray absorbing peak wavelength is measured in the state and the concentration absorbency calibration curve with respect to the electron transport agent is preliminarily made. Next, the ultraviolet ray absorbing measurement is performed with respect to the wet-developing electrophotographic photoconductor immersed in the MORESCO WHITE P-40 according to the calibration curve based on the absorbency of the electron transport agent in the ultraviolet ray absorbing peak wavelength, the elution quantity of the electron transport agent is calculated. The obtained result is shown in Table 6.

(1)-3 Evaluation of Appearance

Further, with respect to the appearance of the wet-developing electrophotographic photoconductor after evaluation of the solvent resistance, the presence/non-presence of generation of the cracks is observed with naked eyes and the appearance evaluation is performed in the same manner as the example 1. The obtained result is shown in Table 6.

Examples 36 to 40

In the examples 36 to 40, except for that electron transport agents (ETM-6 to 7, 9 to 11) are respectively used in place of the electron transport agent (ETM-5) used in the example 35, the wet-developing electrophotographic photoconductor is formed in the same manner as the example 35 and is evaluated. The obtained results are respectively shown in Table 6.

Examples 41, 42

In the example 41, except for that a charge generating agent (CGM-2) is used in place of the charge generating agent (CGM-1) used in the example 37, the wet-developing electrophotographic photoconductor is formed in the same manner and is evaluated.

In the example 42, in the same manner as the example 41, except for that a hole transport agent (HTM-4) is used in place of the hole transport agent (HTM-15) used in the example 41, the wet-developing electro photographic photoconductor is formed and evaluated. The obtained results are respectively shown in Table 6.

Examples 43 to 45

In the examples 43 to 45, in the same manner as the example 37, except for that binding resins (Resin-1, 4, 5) are respectively used in place of the binding resin (Resin-3) used in the example 37, the wet-developing electrophotographic photoconductor is formed and evaluated. The obtained results are respectively shown in Table 6.

Comparison Examples 12 to 15

In the comparison examples 12 to 15, in the same manner as the example 35, except for that electron transport agents (ETM-19 to 22) represented by the following formulae (19) are respectively used in place of the electron transport agent (ETM-5) used in the example 35, the wet-developing electrophotographic photoconductor is formed and evaluated. The obtained results are respectively shown in Table 6.

Formula (19)

ETM-19

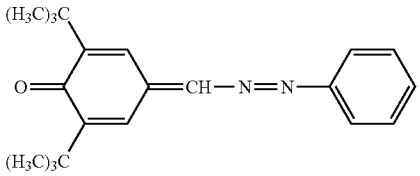

I/O value 0.334

$C_{21}H_{26}N_2O$

Mol. Wt.: 322.44

ETM-20

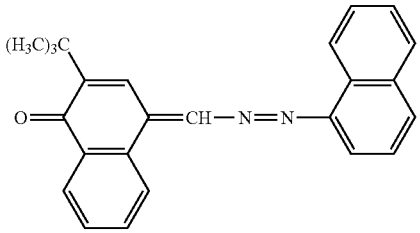

I/O value 0.452

$C_{25}H_{22}N_2O$

Mol. Wt.: 366.45

-continued

ETM-21

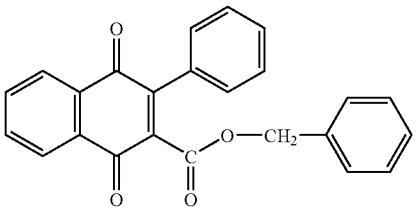

I/O value 0.583

$C_{24}H_{16}O_4$

Mol. Wt.: 368.38

ETM-22

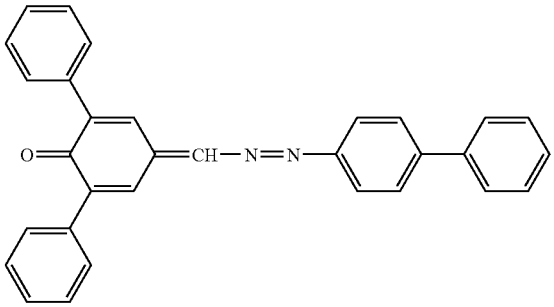

I/O value 0.277

$C_{31}H_{22}N_2O$

Mol. Wt.: 438.52

TABLE 6

| | Electron Transport Agent | | | Charge | Hole | Binding Resin | | Light | Elution | |
|---|---|---|---|---|---|---|---|---|---|---|
| | Kinds | I/O Value | Molecular Weight | Generating Agent | Transport Agent | Kinds | Molecular Weight | Potential (V) | Quantity ($g/cm^3$) | Drum Appearance |
| Example 35 | ETM-5 | 0.860 | 624.68 | CGM-1 | HTM-15 | Resin-3 | 45000 | 114 | $2.2 \times 10^{-7}$ | E |
| Example 36 | ETM-9 | 0.334 | 642.87 | CGM-1 | HTM-15 | Resin-3 | 45000 | 109 | $3.1 \times 10^{-7}$ | G |
| Example 37 | ETM-7 | 0.649 | 658.65 | CGM-1 | HTM-15 | Resin-3 | 45000 | 121 | $1.0 \times 10^{-7}$ | E |
| Example 38 | ETM-10 | 0.318 | 684.95 | CGM-1 | HTM-15 | Resin-3 | 45000 | 115 | $2.8 \times 10^{-7}$ | G |
| Example 39 | ETM-6 | 0.948 | 702.58 | CGM-1 | HTM-15 | Resin-3 | 45000 | 99 | $1.8 \times 10^{-7}$ | E |
| Example 40 | ETM-11 | 0.274 | 883.09 | CGM-1 | HTM-15 | Resin-3 | 45000 | 119 | $1.6 \times 10^{-7}$ | G |
| Example 41 | ETM-7 | 0.649 | 658.65 | CGM-2 | HTM-15 | Resin-3 | 45000 | 97 | $1.0 \times 10^{-7}$ | E |
| Example 42 | ETM-7 | 0.649 | 658.65 | CGM-2 | HTM-4 | Resin-3 | 45000 | 128 | $0.9 \times 10^{-7}$ | E |
| Example 43 | ETM-7 | 0.649 | 658.65 | CGM-1 | HTM-15 | Resin-1 | 47500 | 115 | $1.5 \times 10^{-7}$ | E |
| Example 44 | ETM-7 | 0.649 | 658.65 | CGM-1 | HTM-15 | Resin-4 | 43900 | 112 | $2.6 \times 10^{-7}$ | E |
| Example 45 | ETM-7 | 0.649 | 658.65 | CGM-1 | HTM-15 | Resin-5 | 48100 | 111 | $1.1 \times 10^{-7}$ | E |
| Comparison Example 12 | ETM-19 | 0.334 | 322.44 | CGM-1 | HTM-15 | Resin-3 | 45000 | 110 | $15.1 \times 10^{-7}$ | B |
| Comparison Example 13 | ETM-20 | 0.452 | 366.45 | CGM-1 | HTM-15 | Resin-3 | 45000 | 108 | $12.7 \times 10^{-7}$ | B |
| Comparison Example 14 | ETM-21 | 0.583 | 368.38 | CGM-1 | HTM-15 | Resin-3 | 45000 | 118 | $8.4 \times 10^{-7}$ | F |
| Comparison Example 15 | ETM-22 | 0.277 | 438.58 | CGM-1 | HTM-15 | Resin-3 | 45000 | 105 | $10.1 \times 10^{-7}$ | B |

E: Excellent

G: Good

F: Fair

B: Bad

As shown in the examples 35 to 40 and the comparison examples 12 to 15, the molecular weight of the electron transport agent is increased and the electron transport agent is used in combination with the binding resin having the I/O value of equal to or more than 0.37 and hence, it is possible to reduce the elution quantity of the electron transport agent. Particularly, when the molecular weight of the electron transport agent is set equal to or more than 600, the elution quantity of the electron transport agent exhibits the value equal to or less than $3.5\times10^{-7}$ g/cm$^3$ whereby it is possible to allow the wet-developing electrophotographic photoconductor to exhibit the excellent solvent resistance.

Further, in the examples 41 to 45, even when different kinds of charge generating agents, hole transport agents and the binding resins are used, by setting the molecular weight of the electron transport agent to a value equal to or more than 600, in combination with the binding resin having the I/O value of equal to or more than 0.37, it is possible to allow the wet-developing electrophotographic photoconductor to show excellent solvent resistance.

INDUSTRIAL APPLICABILITY

According to the present invention, when the binding resin having the I/O value of equal to or more than 0.37 is used and the electron transport agent having the I/O value of equal to or more than 0.6 is used, or when the electron transport agent having the molecular weight of equal to or more than 600 and the binding resin having the I/O value of equal to or more than 0.37 are used, the elution quantity of the electron transport agent and the change of sensitivity before and after the immersion experiment can be made small and the drum can obtain the favorable appearance. That is, due to the interaction of the binding resin and the electron transport agent, it is possible to reduce the elution quantity of the hole transport agent. On the other hand, when the electron transport agent having the I/O value of less than 0.6 is used, the elution quantity and the change of sensitivity before and after the immersion experiment are large and, further, small cracks are generated although the cracks do not spread to the whole surface of the specimens. Further, when the binding resin having the I/O value equal to or less than 0.37 is used, the elution quantity and the sensitivity change before and after the immersion experiment are increased and, further, cracks are generated on the whole surface of the some specimens.

On the other hand, so long as the I/O value of the binding resin is less than 0.37 even when the I/O value of the electron transport agent is equal to or more than 0.6 or so long as the I/O value of the electron transport agent is less than 0.6 even when the I/O value of the binding resin is equal to or more than 0.37, the elution quantity of the charge transport agent and the sensitivity change before and after the immersion experiment are increased and hence, the specimens cannot withstand the immersion experiment.

Accordingly, it is found that it is necessary to satisfy both conditions on I/O values of electron transport agent and the binding resin to obtain the photoconductor having the excellent solvent resistance, It is also understood that, when the molecular weight of the electron transport agent is equal to or more than 600 irrespective of the I/O value of the electron transport agent, in combination with the binding resin having the I/O value of equal to or more than 0.37, it is possible to reduce the elution quantity of the charge generating agent and to obtain the small sensitivity change.

That is, by making use of I/O values and the molecular weight as specific physical property indexes of the electron transport agent and the binding resin, it is possible to stably manufacture the wet-developing electrophotographic photoconductor having the uniform characteristics and, at the same time, it is possible to provide the wet-developing electrophotographic photoconductor having the excellent durability and the excellent solvent resistance. Accordingly, it is expected that the wet-developing electrophotographic photoconductor according to the present invention contributes to the reduction of cost, the rapid operation, the high performance, the high durability or the like in various wet-developing image forming devices including copiers and duplicators.

What we claim:

1. A wet-developing electrophotographic photoconductor which forms a photosensitive layer containing at least a charge generating agent, an electron transport agent, a hole transport agent and a binding resin on an electrically conductive base body thereof, wherein the binding resin contains a polycarbonate resin represented by a following general formula (1), and a molecular weight of the hole transport agent assumes a value which is equal to or more than 900, and an inorganic value/organic value (I/O value) of the electron transport agent is set to 0.60 or more, and an inorganic value/organic value (I/O value) of the binding resin is set to 0.37 or more;

(1)

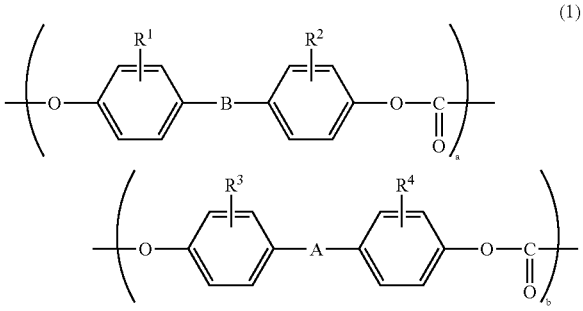

$0.05<a/(a+b)<0.6$ ($R^1$ to $R^4$ in the general formula (1) are respectively independent and represent a hydrogen atom, a halogen atom, a substituted or unsubstituted alkyl group having 1 to 20 carbons, a substituted or unsubstituted aryl group having 6 to 30 carbons and a substituted or unsubstituted halogenated alkyl group having 1 to 12 carbons, and Λ represents —O—, —S—, —CO—, —COO—, —$(CH_2)_2$—, —SO—, —$SO_2$—, —$CR^5R^6$—, —$SiR^5R^6$— or —$SiR^5R^6$—O— ($R^5$ and $R^6$ are respectively independent and represent a hydrogen atom, a substituted or unsubstituted alkyl group having 1 to 8 carbons, a substituted or unsubstituted aryl group having 6 to 30 carbons, a trifluoromethyl group, or a cycloalkylidene having 5 to 12 carbons in which $R^5$ and $R^6$ form a ring and an alkyl group having 1 to 7 carbons may be included as a substituent group) and B represents single bond, —O— or —CO—).

2. The wet-developing electrophotographic photoconductor according to claim 1, wherein a ratio between the inorganic value/organic value (I/O value) of the electron transport agent and the inorganic value/organic value (I/O value) of the binding resin is set to a value which falls within a range of 1.5 to 3.0.

3. The wet-developing electrophotographic photoconductor according to claim 1, wherein $R^5$ and $R^6$ in the general formula (1) differ in kinds and $R^5$ and $R^6$ possess an asymmetric relationship.

4. The wet-developing electrophotographic photoconductor according to claim 1, wherein a viscosity average molecular weight of the binding resin assumes a value which falls within a range of 40,000 to 80,000.

5. The wet-developing electrophotographic photoconductor according to claim 1, wherein a molecular weight of the electron transport agent assumes a value which is equal to or more than 600.

6. The wet-developing electrophotographic photoconductor according to claim 1, wherein an addition quantity of the electron transport agent assumes a value which falls within a range of 10 to 100 parts by weight with respect to 100 parts by weight of the binding resin.

7. The wet-developing electrophotographic photoconductor according to claim 1, wherein an addition quantity of the hole transport agent assumes a value which falls within a range of 10 to 80 parts by weight with respect to 100 parts by weight of the binding resin.

8. The wet-developing electrophotographic photoconductor according to claim 1, wherein the hole transport agent has the stilbene structure represented by a following general formula (2):

(2)

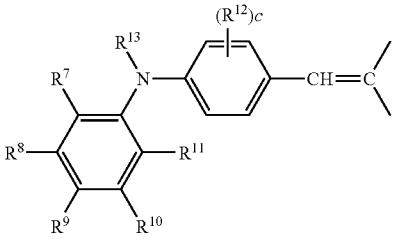

(In the general formula (2), $R^7$ to $R^{13}$ are respectively independent, and represent a hydrogen atom, a halogen atom, a substituted or unsubstituted alkyl group having 1 to 20 carbons, a substituted or unsubstituted alkenyl group having 2 to 20 carbons, a substituted or unsubstituted aryl group having 6 to 30 carbons, a substituted or unsubstituted aralkyl group having 6 to 30 carbons, a substituted or unsubstituted azo group, or a substituted or unsubstituted diazo group having 6 to 30 carbons and the repetition number c is an integer from 1 to 4).

9. The wet-developing electrophotographic photoconductor according to claim 1, wherein an elution quantity of the hole transport agent is equal to or below $5\times10^{-7}$ g/cm$^3$ when the wet-developing electrophotographic photoconductor is immersed in a hydrocarbon-based solvent used as a wet-developing developer under conditions of a room temperature and 600 hours.

10. The wet-developing electrophotographic photoconductor according to claim 1, wherein photosensitive layer is a single-layer type.

11. A wet-developing image forming device which includes the wet-developing electrophotographic photoconductor described in claim 1, and arranges a charging step, an exposure step, a developing step and a transfer step respectively around the wet-developing electrophotographic photoconductor.

* * * * *